US007488396B2

(12) United States Patent
Hashimura et al.

(10) Patent No.: US 7,488,396 B2
(45) Date of Patent: Feb. 10, 2009

(54) SUPERIOR IN MACHINABILITY AND METHOD OF PRODUCTION OF SAME

(75) Inventors: Masayuki Hashimura, Muroran (JP); Atsushi Mizuno, Muroran (JP); Kenichiro Naito, Tokyo (JP); Hiroshi Hagiwara, Tokyo (JP); Kohichi Isobe, Muroran (JP); Hiroshi Hirata, Muroran (JP)

(73) Assignee: Nippon Steel Corporation, Tokyo (JP)

( * ) Notice: Subject to any disclaimer, the term of this patent is extended or adjusted under 35 U.S.C. 154(b) by 401 days.

(21) Appl. No.: 10/534,858

(22) PCT Filed: Nov. 14, 2003

(86) PCT No.: PCT/JP03/14547

§ 371 (c)(1),
(2), (4) Date: May 13, 2005

(87) PCT Pub. No.: WO2004/050932

PCT Pub. Date: Jun. 17, 2004

(65) Prior Publication Data

US 2006/0013720 A1 Jan. 19, 2006

(30) Foreign Application Priority Data

| | | |
|---|---|---|
| Nov. 15, 2002 | (JP) | 2002-332658 |
| Nov. 15, 2002 | (JP) | 2002-332665 |
| Nov. 15, 2002 | (JP) | 2002-332668 |
| Nov. 15, 2002 | (JP) | 2002-332669 |
| Nov. 15, 2002 | (JP) | 2002-332695 |
| Nov. 15, 2002 | (JP) | 2002-332707 |
| Nov. 4, 2003 | (JP) | 2003-374489 |
| Nov. 4, 2003 | (JP) | 2003-374511 |
| Nov. 4, 2003 | (JP) | 2003-374517 |

(51) Int. Cl.
*C22C 38/60* (2006.01)
*C22C 38/02* (2006.01)
*C22C 38/04* (2006.01)

(52) U.S. Cl. ..... 148/330; 148/320; 148/328; 420/87; 420/88; 420/121; 420/120; 420/128

(58) Field of Classification Search ..... 420/87, 420/121, 120, 128, 88; 148/320, 328, 330–335
See application file for complete search history.

(56) References Cited

U.S. PATENT DOCUMENTS 4,279,646 A 7/1981 Kato et al.

FOREIGN PATENT DOCUMENTS

DE 3718772 A1 12/1987

(Continued)

OTHER PUBLICATIONS

Japanese Office Action dated May 20, 2008 issued in corresponding Japanese Application No. 2002-332668.

(Continued)

*Primary Examiner*—Deborah Yee
(74) *Attorney, Agent, or Firm*—Kenyon & Kenyon LLP

(57) ABSTRACT

The present invention provides steel superior in machinability comprised of, by wt %, C: 0.005 to 0.2%, Si: 0.001 to 0.5%, Mn: 0.2 to 3.0%, P: 0.001 to 0.2%, S: 0.03 to 1.0%, T.N: 0.002 to 0.02%, T.O: 0.0005 to 0.035%, and the balance of Fe and unavoidable impurities, said steel satisfying one or both of Mn/S in the steel being 1.2 to 2.8 or an area ratio of pearlite over a grain size of 1 μm in a microstructure of the steel being not more than 5%.

2 Claims, 7 Drawing Sheets

FOREIGN PATENT DOCUMENTS

| | | | |
|---|---|---|---|
| JP | 61-104049 | | 5/1986 |
| JP | 02047240 | * | 2/1990 |
| JP | 07-034189 | | 2/1995 |
| JP | 11-293391 | | 10/1999 |
| JP | 2000-034538 | | 2/2000 |
| JP | 2000-160284 | * | 6/2000 |
| JP | 2000160284 | | 6/2000 |
| JP | 2000-319753 | | 11/2000 |
| JP | 2001-329335 | | 11/2001 |
| JP | 2002-3991 | | 1/2002 |
| JP | 2002-249823 | | 9/2002 |

OTHER PUBLICATIONS

Japanese Office Action dated May 20, 2008 issued in corresponding Japanese Application No. 2002-332658.

* cited by examiner

SUPERIOR IN MACHINABILITY AND METHOD OF PRODUCTION OF SAME

TECHNICAL FIELD

The present invention relates to steel used for automobiles, general machinery, etc. and a method of production of the same, more particularly relates to steel superior in machinability which is superior in tool life and cut surface roughness at the time of cutting and chip disposal and a method of production of the same.

BACKGROUND ART

General machinery and automobiles are produced by assembling large numbers of parts. From the viewpoint of the precision requirements and production efficiency, the parts are in many cases produced through a cutting process. At this time, reduction of costs and improvement of production efficiency are required improvement of the machinability of the steel is also sought. In particular, conventional SUM23 and SUM24 have been developed stressing machinability. Up to now, it has been known that to improve the machinability, addition of S, Pb, or another machinability improving element is effective. However, some users sometimes avoid use of Pb due to its environmental burden. As a general direction, the amount of use is being reduced.

Up until now, when not adding Pb, the technique has been used of improving the machinability by forming inclusions such as S such as MnS becoming soft in a cutting condition. However, a similar amount of S as with the low carbon and sulfur free-machining steel SUM23 is added to so-called low carbon and lead free-machining steel SUM24L. Therefore, it is necessary to add an amount of S more than the past. However, with addition of a large amount of S, if just making the MnS coarser, not only is it necessary to obtain an MnS distribution efficient for improving the machinability, but these form starting points of fracture in rolling, forging, etc. and cause many problems in production. Further, in sulfur free-machining steel based on SUM23, the built-up edges easily form causing relief shapes at the cut surface and deterioration of the surface roughness accompanied with detachment of the built-up edges and breakoff of chips. Therefore, from the viewpoint of the machinability as well, there is the problem of a drop in precision due to the deterioration of the surface roughness. In chip disposal as well, it is considered better that the chips be able to be broken short, but with just simple addition of S, the ductility of the matrix is large, so sufficient breakage is not possible and no major improvement can be obtained.

Further, elements other than S such as Te, Bi, and P are known as elements for improving machinability, but the fact that even if improving the machinability to some extent, cracks easily occur at hot rolling or hot forging, so these are preferably made as low in content as possible is disclosed in Japanese Unexamined Patent Publication (Kokai) No. 9-71840, Japanese Patent Application No. 2000-160284, Japanese Unexamined Patent Publication (Kokai) No. 2000-219936, and Japanese Unexamined Patent Publication (Kokai) No. 2001-329335.

Further, Japanese Unexamined Patent Publication (Kokai) No. 11-222646 proposes a method of improving chip disposal by making the establishing the presence of at least 30 sulfides of 20 μm or more alone or groups of sulfides comprised of pluralities of sulfides connected substantially linearly in lengths of 20 μm or more in an observation field of a cross-section of 1 $mm^2$ in the rolling direction. However, the dispersion of sulfides of the submicron level most effective for machinability in practice, including the method of production, is not alluded to. Further, not much can be expected in view of the ingredients as well.

Further, Japanese Unexamined Patent Publication (Kokai) No. 11-293391 proposes a method of improving the chip disposal by making the average size of the sulfide inclusions 50 $\mu m^2$ or less and establishing the presence of 750 or more sulfide inclusions per 1 $mm^2$. However, the dispersion of sulfides of the submicron level most effective for machinability in practice is not alluded to at all like in Japanese Unexamined Patent Publication (Kokai) No. 11-222646. Further, the technology for deliberately creating this and the method for investigating this are not described either.

On the other hand, cutting tool life tends to be focused on since it has a direct effect on the production efficiency etc., but even in machinability, surface roughness is high in technical difficulty. Surface roughness is affected by the inherent properties of the cut material, so it was difficult to obtain a surface roughness equal to or greater than that of conventional steel. The surface roughness is directly linked with the performance of the part, so deterioration of the surface roughness becomes a cause of decline in part performance or an increase in the defect rate at the time of product production and is often stressed more than tool life. In this sense, conventional lead free-machining steel was superior. Compared with simple sulfur free-machining steel, it is superior not only the tool life, but also the surface roughness, so much use has been made of it for preventing a drop in part performance.

In technology relating to steel for improving the surface roughness, in general free-machining elements such as Pb and Bi are added. In addition, however, for example, as seen in Japanese Unexamined Patent Publication (Kokai) No. 5-345951, for securing a desired surface roughness by making the average size of the MnS inclusions finer to not more than 50 $\mu m^2$, graphite free-machining steel superior in tool life and finished surface roughness characterized by containing graphite having an average cross-sectional area of 5 to 30 $\mu m^2$ in an amount of 0.20 to 1.0% in a ferrite matrix has been seen. However, even with these techniques, it is difficult to obtain a surface roughness equal to or better than that of conventional lead free-machining steel. That is, so-called low carbon and lead free-machining steel SUM24L has been superior in surface roughness in the past. The reason is believed to be that the level of fine dispersion of inclusions defined in these only concerns grains of an average size of 3 μm or so, so homogeneous dispersion is insufficient and therefore built-up edges easily are formed and the surface roughness cannot be improved as much as that of conventional lead free-machining steel.

DISCLOSURE OF INVENTION

The present invention provides steel having a good surface roughness and a method of production of the same which avoid problems in hot rolling and hot forging while improving both the tool life and surface roughness and giving a machinability at least equivalent to that of conventional low carbon and lead free-machining steel.

Cutting is a fracture phenomenon of breaking off chips. Promotion of this is one point. In particular, to obtain a good surface roughness, the inventors caused embrittlement of the matrix so as to facilitate fracture and thereby extend tool life and also suppressed nonuniformity in the steel to a minimum so as to cause a fracture phenomenon stable even on the micro level and thereby suppress roughness of the cut surface. Specifically, the inventors took note of the distribution of pearlite in steel and caused C to uniformly disperse as fine pearlite (strictly speaking cementite) in steel so as to cause stable fracture and thereby create a cut surface with no roughness and provided a method of production enabling this. The gist of the present invention is as follows;

According to the present invention, there is provided a (1) Steel superior in machinability comprised of, by wt %, C: 0.005 to 0.2%,
Si: 0.001 to 0.5%,
Mn: 0.2 to 3.0%,
P: 0.001 to 0.2%,
S: 0.03 to 1.0%,
T.N: 0.002 to 0.02%,
T.O: 0.0005 to 0.035%, and the balance of Fe and unavoidable impurities, said steel satisfying one or both of Mn/S in the steel being 1.2 to 2.8 or an area ratio of pearlite over a grain size of 1 μm in a microstructure of the steel being not more than 5% and a surface roughness Rz of the steel being not more than 11 μm.

(2) Steel superior in machinability characterized by containing, by wt %, C: 0.005% to 0.2%, Mn: 0.3 to 3.0%, and S: 0.1 to 1.0%, by having a density of MnS having a circle equivalent diameter of 0.1 to 0.5 μm at a cross-section parallel to a rolling direction of the steel material, taken from an extraction replica and observed by a transmission electron microscope, of at least 10,000/mm$^2$, and by having a cut surface roughness Rz of the steel of not more than 11 μm.

(3) Steel superior in machinability as set forth in (1) or (2), said steel characterized by further containing B:0.0005 to 0.05 wt %.

(4) Steel superior in machinability as set forth in (1), said steel characterized by having a density of MnS having a circle equivalent diameter of 0.1 to 0.5 μm at a cross-section parallel to a rolling direction of the steel material, taken from an extraction replica and observed by a transmission electron microscope, of at least 10,000/mm$^2$.

(5) Steel superior in machinability as set forth in (1), said steel characterized by further restricting the amount of S to 0.25 to 0.75 wt % and the amount of B to 0.002 to 0.014 wt %, by containing amounts of S and B in a region surrounded by A, B, C, and D shown in FIG. 4 where the contents of S and B satisfy the following equation (1), and by containing sulfides with BN precipitated in MnS:

$$(B-0.008)^2/0.006^2+(S-0.5)^2/0.25^2 \leqq 1 \quad (1)$$

(6) Steel superior in machinability as set forth in (1) or (2), said steel characterized by further containing, by wt %, one or more of, V: 0.05 to 1.0%,
Nb: 0.005 to 0.2%,
Cr: 0.01 to 2.0%,
Mo: 0.05 to 1.0%,
W: 0.5 to 1.0%,
Ni: 0.05 to 2.0%,
Cu: 0.01 to 2.0%,
Sn: 0.005 to 2.0%,
Zn: 0.0005 to 0.5%,
Ti: 0.0005 to 0.1%,
Ca: 0.0002 to 0.005%,
Zr: 0.0005 to 0.1%,
Mg: 0.0003 to 0.005%,
Te: 0.0003 to 0.05%,
Bi: 0.005 to 0.5%,
Pb: 0.01 to 0.5%, and
Al: ≦0.015%.

(7) A method of production of steel superior in machinability as set forth in any one of (1) to (3), said method of production of steel characterized by casting molten steel having the steel ingredients as set forth in (1), then cooling at a cooling rate of 10 to 100° C./min, hot rolling, then cooling at a cooling rate of at least 0.5° C./sec in a range from an $A_3$ point to 550° C.

(8) A method of production of steel superior in machinability as set forth in (4) or (5), said method of production of steel characterized by casting molten steel having the steel ingredients as set forth in (2), then cooling at a cooling rate of 10 to 100° C./min, restricting a finishing temperature of hot rolling to at least 1,000° C., then cooling at a cooling rate of at least 0.5° C./sec in a range from an $A_3$ point to 550° C.

(9) A method of production of steel superior in machinability as set forth in any one of (1) to (6), said method of production of steel characterized by restricting a heating temperature for adjusting hardness to not more than 750° C. after the cooling after the hot rolling.

(10) A method of production of steel as described in any one of (7) to (9), wherein said steel is steel superior in machinability characterized by further containing, by wt %, one or more of, V: 0.05 to 1.0%,
Nb: 0.005 to 0.2%,
Cr: 0.01 to 2.0%,
Mo: 0.05 to 1.0%,
W: 0.5 to 1.0%,
Ni: 0.05 to 2.0%,
Cu: 0.01 to 2.0%,
Sn: 0.005 to 2.0%,
Zn: 0.0005 to 0.5%,
Ti: 0.0005 to 0.1%,
Ca: 0.0002 to 0.005%,
Zr: 0.0005 to 0.1%,
Mg: 0.0003 to 0.005%,
Te: 0.0003 to 0.05%,
Si: 0.005 to 0.5%,
Pb: 0.01 to 0.5%, and
Al: ≦0.015%.

BEST MODE FOR CARRYING OUT THE INVENTION

Figure 1:
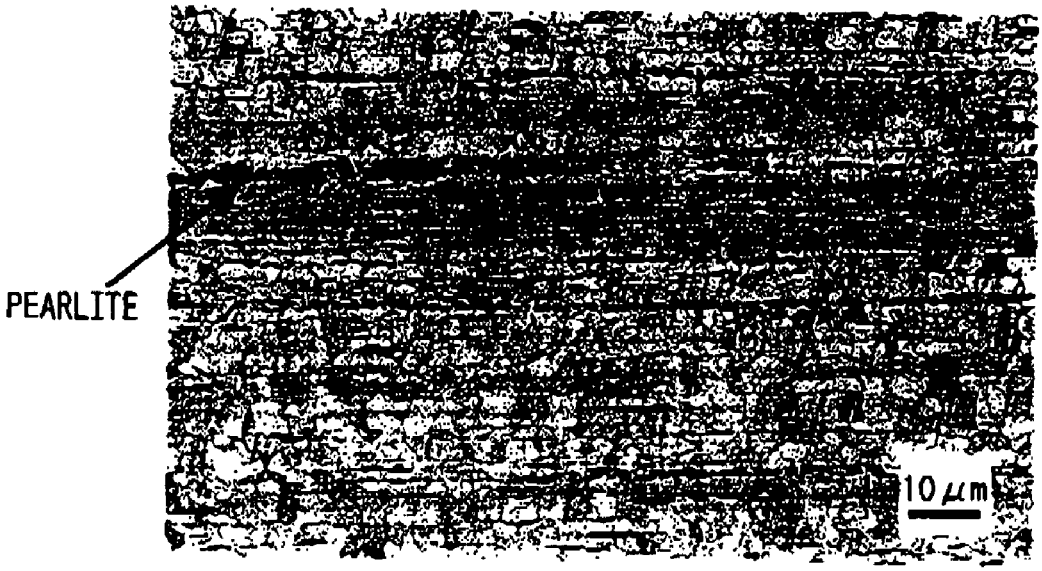
FIG. 1 is an opticalmicrograph of a ferrite-pearlite structure of steel according to the present invention.

The present invention is characterized by causing embrittlement of the matrix so as to obtain a sufficient machinability, in particular a good surface roughness, without adding lead and by adding a large amount of B to obtain good lubrication of the contact surfaces of the tool/cut material. Further, a relatively large amount of S is also added and the ratio of amounts of addition of Mn and S is precisely controlled to cause them to fine disperse. Further, for the microstructure of the steel, the pearlite seen in conventional carbon steel is controlled. That is, this is steel superior in machinability comprised of chemical ingredients, suppressed in the amount of addition of C, suppressed in the precipitation of coarse pearlite, or, in the case of including too much C, suppressed in coarse pearlite grains by heat treatment, that is, suppressed in pearlite bands often seen in natural cooling.

Next, the reasons for limiting the steel ingredients defined in the present invention will be explained.

C is related to the basic strength of the steel and the amount of oxygen in the steel, so has a great effect on the machinability. If a large amount of C is added to raise the strength, the machinability declines, so the upper limit was made 0.2%. On the other hand, to prevent the generation of hard oxides lowering the machinability and suppress the pinholes in the solidification process or other damage of dissolved oxygen at a high temperature, it is necessary to control the amount of oxygen to a suitable amount. If just reducing the amount of C by blow refining, not only does the cost mount, but also a large amount of oxygen remains in the steel and becomes a cause of pinholes and other problems. Therefore, the lower limit was made a 0.005% amount of C able to easily prevent pinholes and other problems. The preferable lower limit of the amount of C is 0.05%.

Excessive addition of Si produces hard oxides and lowers the machinability, but suitable addition softens the oxides and does not reduce machinability. The upper limit is 0.5%. Above that, hard oxides are produced. At 0.001% or less, softening of oxides becomes difficult and the cost increases industrially.

Mn is necessary for bonding with sulfur in the steel as MnS. Further, it is necessary to soften the oxides in the steel and make the oxides harmless. The effect depends on the amount of S added, but if 0.2% or less, the added S cannot be sufficiently bonded as MnS and the S becomes FeS causing embrittlement. If the amount of Mn becomes large, the hardness of the base material becomes larger and the machinability and cold workability fall, so 3.0% was made the upper limit.

P causes the hardness of the base material to become greater in the steel. Not only the cold workability, but also the hot workability and casting properties fall, so the upper limit has to be made 0.2%. On the other hand, the lower limit value was made 0.001% by elements with the effect of raising the machinability.

S bonds with Mn and is present as MnS inclusions. MnS improves the machinability, but stretched MnS is one cause of anisotropy at casting. Large MnS should be avoided, but addition of a large amount is preferable from the viewpoint of improvement of the machinability. Therefore, it is preferable to cause the MnS to finely disperse. For improvement of the machinability to at least that of the conventional sulfur free-machining steel in the case of no addition of Pb, addition of at least 0.03% is necessary. On the other hand, if over 1%, not only cannot production of coarse MnS be avoided, but also cracks occur during production due to deterioration of the casting properties and hot deformation properties due to the FeS etc., so this was made the upper limit.

B has the effect of improving the machinability when precipitated as BN. This effect is not remarkable at 0.0005% or less, while the effect is saturated even if B is added in an amount of over 0.05%. If too much BN is precipitated, conversely cracks occur during production due to deterioration of the casting properties and hot deformation properties. Therefore, the range was made over 0.0005 to 0.05%.

Figure 4:
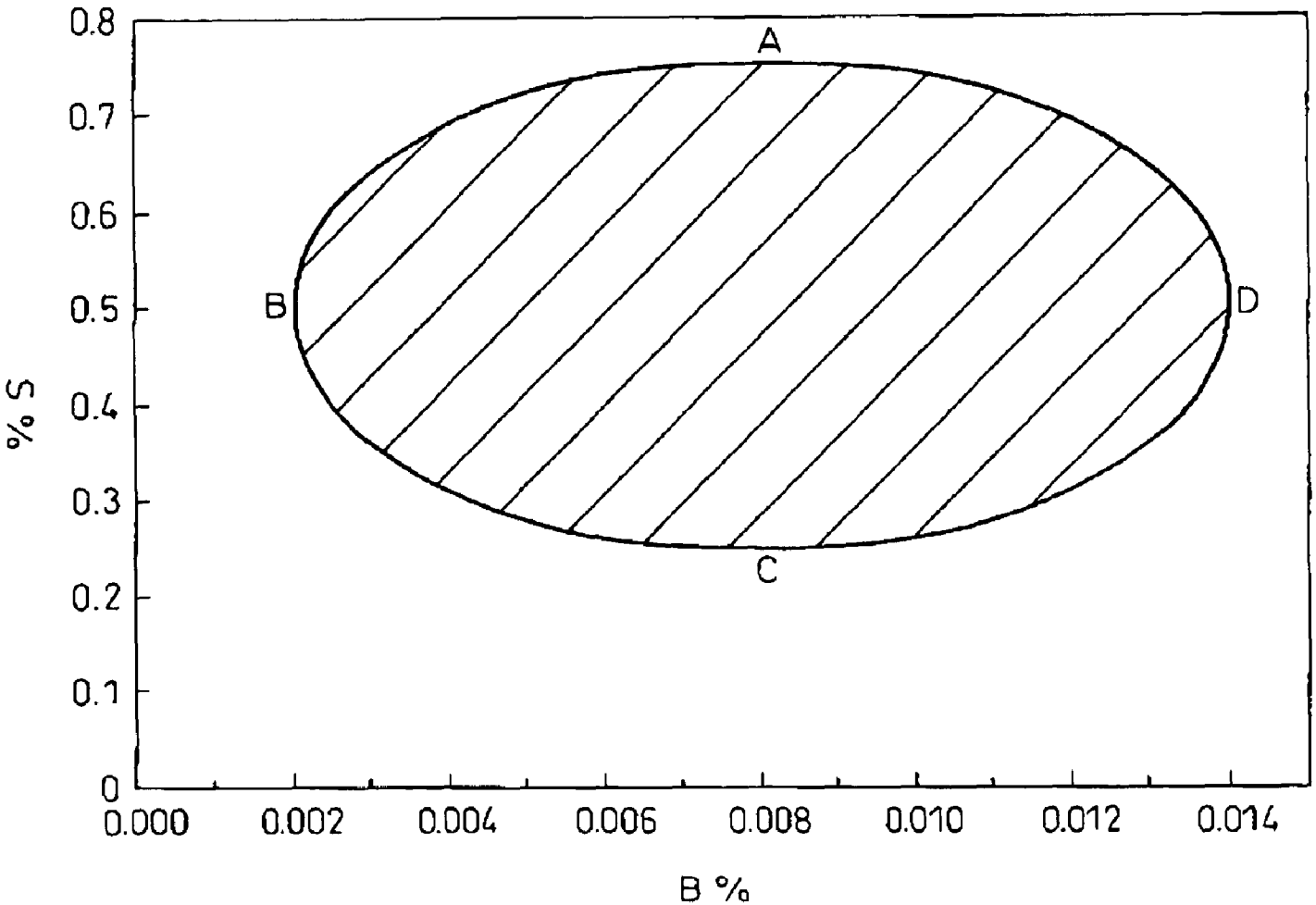
FIG. 4 is a view of an optimal range of an amount of S and an amount of B according to the present invention.

In the present invention, the best properties are obtained by limiting the region surrounded by A, B, C, and D in the ellipse shown in FIG. 4 strictly limited in the amount of S and amount of B as explained above to the region of equation (1):

$$(B-0.008)^2/0.006^2+(S-0.5)^2/0.25^2 \leqq 1 \quad (1)$$

N (total-N) causes the steel to harden in the case of dissolved N. In particular, in cutting, it hardens near the cutting edge due to dynamic strain ageing and thereby reduces the tool life, but also has the effect of improving the cut surface roughness. Further, it bonds with B to produce BN and improve the machinability. At 0.002% or less, no effect of improvement of the surface roughness due to dissolved nitrogen or effect of improvement of the machinability due to BN can be observed, so this was made the lower limit. Further, if over 0.02%, the dissolved nitrogen is present in a large amount, so conversely the tool life is lowered. Further, bubbles are formed in the middle of casting and become causes of defects etc. Therefore, in the present invention, the upper limit was made 0.02% where these deleterious effects become remarkable.

O (total O) forms bubbles during cooling in the case of presence in the free state and becomes causes of pinholes. Further, control is necessary for softening the oxides and suppressing hard oxides harmful to machinability. Further, oxides are utilized as nuclei for precipitation at the time of fine dispersion of MnS. If under 0.0005%, sufficient fine dispersion of MnS is not possible, crude MnS is generated, and there is a detrimental effect on the mechanical properties as well, so the lower limit was made 0.0005%. Further, if the amount of oxygen exceeds 0.035%, bubbles form during casting to cause pinholes, so the upper limit was made 0.035%.

Figure 3:
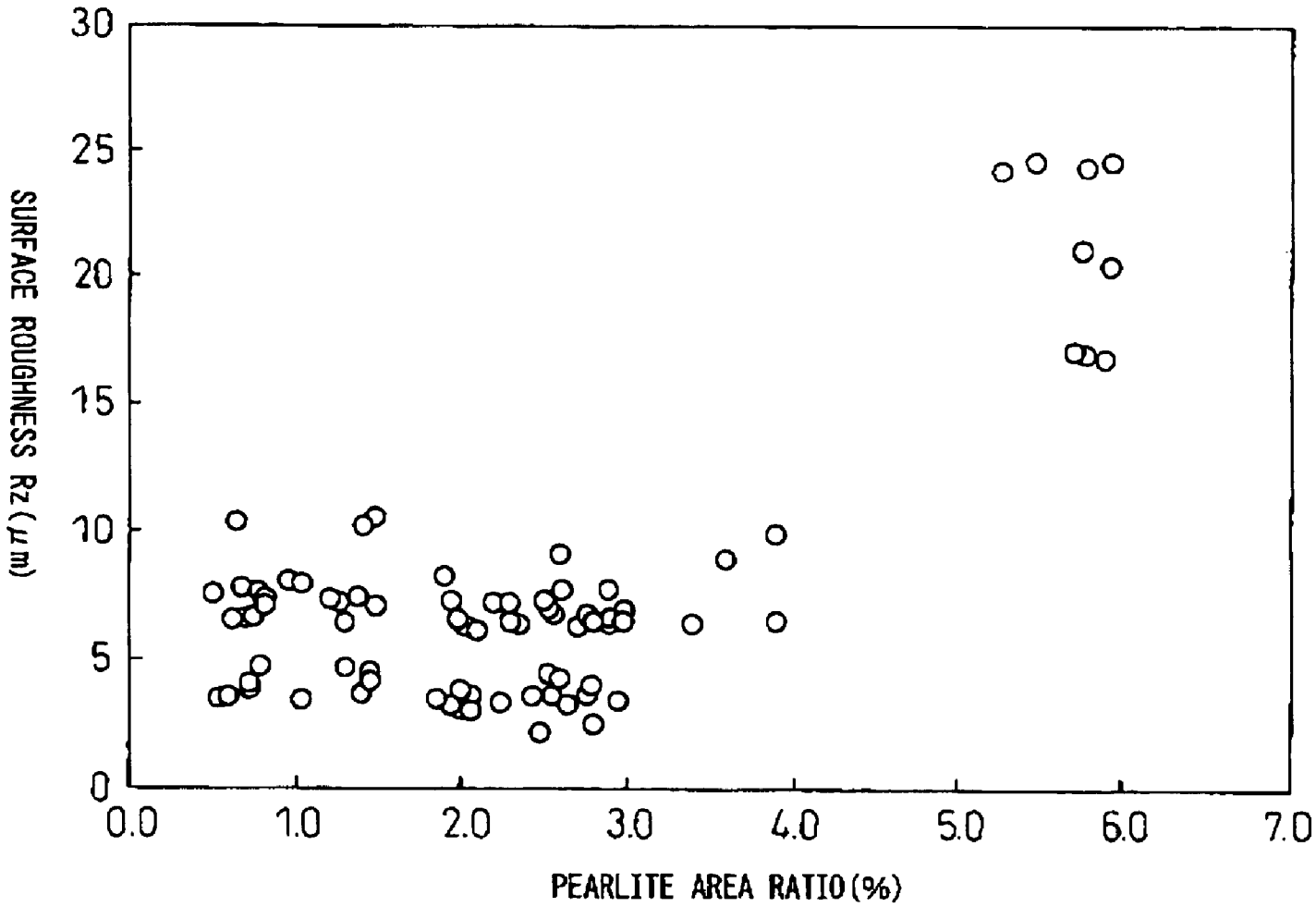
FIG. 3 is a view of the relationship of a pearlite area ratio and surface roughness.

Next, the reasons for limiting the area ratio of pearlite to 5% or less will be explained. In general, if the steel containing carbon is cooled from a transformation temperature or higher, a ferrite-pearlite structure is formed. In the case of steel containing a small amount of C covered by the present invention, if air cooling from a transformation temperature ($A_3$ point) or more, then cutting out a piece, mirror polishing the inside, then etching by Nytal, it is possible to observe the microstructure as shown in FIG. 1. The black grains are compound structures of ferrite and cementite called "pearlite". Normally, the grains appearing black due to Nytal are harder than the ferrite grains appearing white. In the deformation/fracture behavior of steel, these exhibit behavior locally different from ferrite grains. This impairs the uniform deformation/fracture in the breakage behavior of chips at cutting, so greatly contributes to the formation of built-up edges and degrades the surface roughness of the cut surface. Therefore, it is important to eliminate the structural uniformity derived from the C. Therefore, the black grains etched by Nytal are deemed to be pearlite grains. If there are too many pearlite grains, structural uniformity occurs and becomes a cause of deterioration of surface roughness, so the area ratio was restricted to not more than 5% and the surface roughness Rz to not more than 11 μm. FIG. 3 shows the relationship between the pearlite area ratio and surface roughness.

Here, details of the method of measurement will be explained. The hot rolled or hot forged steel is cut to a the longitudinal cross-section (L-cross section) and buried in resin. The piece was then polished to a mirror finish and etched by Nytal. The grains (circle equivalent diameter) of 1 μm or more, except the gray MnS, in the steel etched black by Nytal were analyzed by an image processing system to find the area ratio. At the time of the image processing for measurement of the area ratio, the image contrast was adjusted by the "threshold" setting matched with the pearlite appearing black and the inclusions appearing gray (MnS etc.) were erased from the screen so as to measure only the pearlite. The minimum pearlite detectable at this time is about 1 μm. Pearlite of less than 1 μm size does not have any effect on the machinability, so there is no effect even if not detected.

In the present invention, the measurement fields consisted of 20 fields of 0.2 $mm^2$ (0.4 mm×0.5 mm) at a power of ×400. The pearlite area ratio was calculated for a total area of 4 $mm^2$.

Regarding Mn/S, it is already known that this has a large effect on the hot ductility and that normally if Mn/S>3, the production efficiency is greatly reduced. The reason is the production of FeS. In the present invention, however, in the low C and high S region, the inventors discovered that this ratio can be reduced to Mn/S: 1.2 to 2.8. With an Mn/S of less than 1.2, a large amount of FeS is produced, the hot ductility is sharply reduced, and the production efficiency is greatly reduced.

Figure 2B:
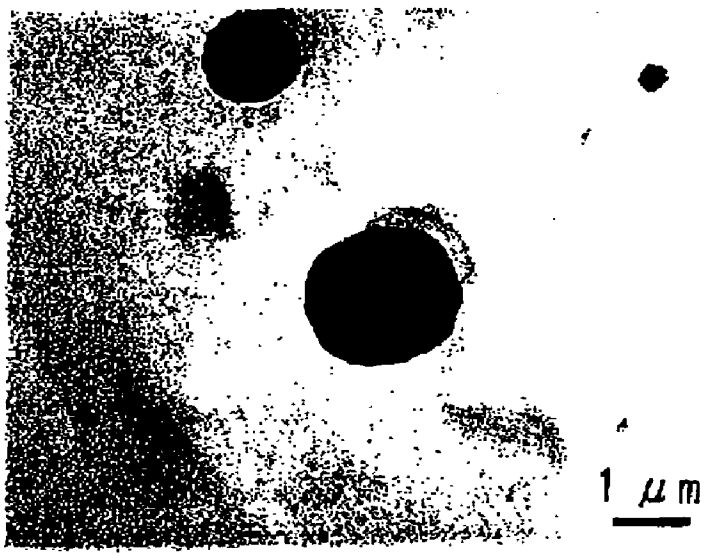
FIG. 2(*a*) is an opticalmicrograph of a state of fine diffusion of MnS according to the present invention, while FIG. 2(*b*) is an opticalmicrograph of a state of presence of crude MnS in conventional steel.
Figure 2A:
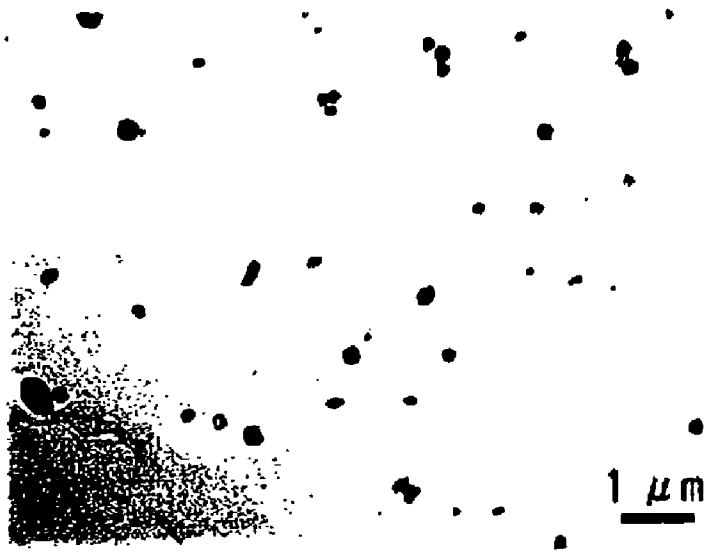

FIG. 2 shows examples of observation of fine MnS in the cases where Mn/S≦2.8 and Mn/S>2.8 under a transmission type electron microscope using the replica method. When Mn/S>2.8, the result becomes only coarse MnS such as shown in FIG. 2(*b*) and the surface roughness cannot be reduced. On the other hand, when restricted to Mn/S:1.2 to 2.8, production of fine MnS such as shown in FIG. 2(*a*) is obtained.

The number of the fine MnS can be increased by repeating a process of continuous casting or ingot casting, then heating to 900° C. or more.

Next, the reason for defining the density of MnS of a circle equivalent diameter of 0.1 to 0.5 μm as at least 10,000/$mm^2$ in the type of MnS and its size and distribution will be explained.

MnS is an inclusion improving the machinability. By causing fine dispersion at a high density, the machinability is remarkably improved. To obtain this effect, it is necessary that the density of MnS of a circle equivalent diameter of 0.1 to 0.5 μm be at least 10,000/$mm^2$. The MnS sulfides are usually observed in distribution by an opticalmicroscope and measured for dimensions and density. MnS sulfides of these dimensions cannot be confirmed by observation under an opticalmicroscope. They can only be observed first by a transmission type electron microscope (TEM). They are sulfides mainly comprised of MnS of dimensions where a clear difference can be recognized under TEM observation even if there is no difference in dimensions and density under observation by an opticalmicroscope. In the present invention, this is controlled and the form of presence is converted to numerical values to differentiate it from the prior art.

To establish the presence of MnS exceeding the above dimensions in a density of 10,000/$mm^2$ or more, it is necessary to add a large amount of S over the range of the present invention. If adding a large amount, there probability rises of a large number of coarse MnS also being present and causing anisotropy at forging. If the MnS exceeds this dimension due to the amount of addition of S in the range defined by the present invention, the amount of MnS becomes insufficient and the density required for improvement of the machinability can no longer be maintained. Further, if a minimum diameter of 0.1 μm or less, there is substantially no effect on the machinability. Therefore, it is necessary that the density of MnS of a circle equivalent diameter of 0.1 to 0.5 μm be at least 10,000/$mm^2$. To obtain the dimensions and density of MnS, it is more effective to not only control the cooling rate, but also make the ratio of Mn and S contained 1.5 to 2.5.

Figure 5:
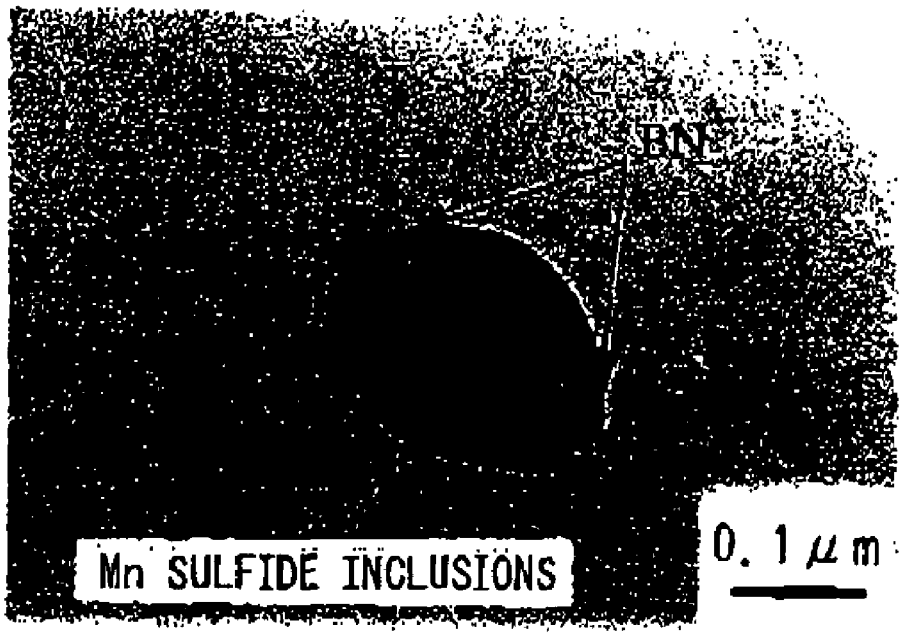
FIG. 5 is a photograph of a TEM replica showing a state of sulfides having MnS as a main ingredient and having BN compound precipitated according to the present invention.

Further, in the present invention, as shown in FIG. 5 in the above MnS, it is important that the above-mentioned MnS, as shown in FIG. 5, has the form of a sulfide with at least 10 wt % of boronitride (BN) compound precipitated.

BN normally easily precipitates at the crystal boundaries and has difficulty uniformly dispersing in the matrix. Therefore, it is not possible to cause uniform embrittlement of the matrix required for improving the machinability and not possible to sufficiently obtain the effect of BN. For uniform dispersion in the matrix, it is necessary to cause MnS, which forms sites for precipitation of BN and is also effective for improving machinability, to uniformly disperse in the matrix. By making BN and MnS compound precipitate, uniform dispersion of BN is promoted and the machinability is greatly improved. Therefore, it is necessary that at least 10% of BN compound precipitate with MnS.

Figure 6:
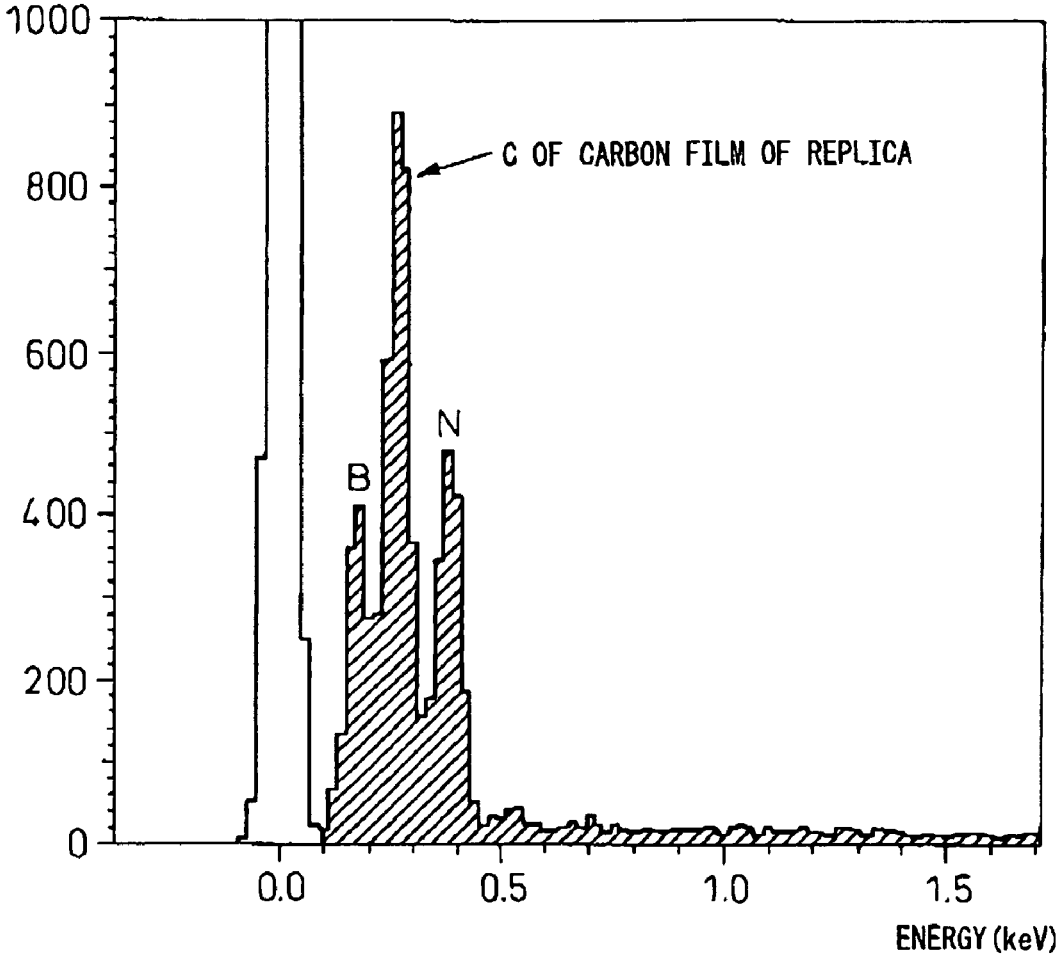
FIG. 6 is a view of the results of EDX analysis of BN.

The BN referred to here, FIG. 5 showing a TEM replica photograph thereof, indicates a compound of B and N where peaks of B and N are clearly recognized in EDX analysis of FIG. 6.

Note that "MnS" includes not only pure MnS, but also inclusions including mainly MnS and having sulfides of Fe, Ca, Ti, Zi, Mg, REM, etc. dissolved in or bonded with the MnS for copresence, inclusions like MnTe where elements other than S form compounds with Mn and dissolve in or bond with MnS for copresence, and the above inclusions precipitated using oxides as nuclei. It is a general term for Mn sulfide-type inclusions able to be expressed by the chemical formula (Mn, X) (S, Y) (where X: sulfide forming elements other than Mn and Y: element binding with Mn other than S).

Next, in the present invention, in addition to the above ingredients, it is possible to add one or two or more of V, Nb, Cr, Mo, W, Ni, Sn, Zn, Ti, Ca, Zr, Mg, Te, Bi, and Pb in accordance with need.

V forms a carbonitride and can strengthen the steel by secondary precipitation hardening. At 0.05% or less, there is no effect on raising the strength, while if added in an amount over 1.0%, a large amount of carbonitrides is precipitated and conversely the mechanical properties are impaired, so this was made the upper limit.

Nb also forms a carbonitride and can strengthen the steel by secondary precipitation hardening. At 0.005% or less, there is no effect on raising the strength, while if added in an amount over 0.2%, a large amount of carbonitrides is precipitated and conversely the mechanical properties are prevented, so this was made the upper limit.

Cr is an element improving quenchability and imparting temper softening resistance. Therefore, this is added to steel requiring higher strength. In this case, addition of 0.01% or more is required. Further, if added in a large amount, Cr carbides are produced, so the upper limit was made 2.0%.

Mo is an element imparting temper-softening resistance and improving the quenchability. At under 0.05%, that effect cannot be detected, while even if added at over 1.0%, the effect is saturated, so the range of addition was made 0.05% to 1.0%.

W forms carbides and can strengthen the steel by secondary precipitation hardening. If 0.05% or less, there is no effect on raising the strength, while if added over 1.0%, a large amount of carbides precipitate and conversely the mechanical properties are prevented, so this was made the upper limit.

Ni strengthens the ferrite, improves the ductility, and is also effective in improving the quenchability and improving the corrosion resistance. If less than 0.05%, this effect cannot be observed, while even if added over 2.0%, the effect is saturated in the point of the mechanical properties, so this was made the upper limit.

Cu strengthens the ferrite and is effective for improving the quenchability and improves the corrosion resistance. If under 0.01%, this effect cannot be observed, while even if added over 2.0%, the effect is saturated in the point of the mechanical properties, so this was made the upper limit. In particular, the hot ductility is reduced and defects are easily caused at the time of rolling, so it is preferable to simultaneously add Ni.

Sn has the effect of causing embrittlement of ferrite, extending the tool life, and improving the surface roughness. If less than 0.005%, this effect cannot be observed, while even if added over 2.0%, the effect is saturated in the point of the mechanical properties, so this was made the upper limit.

Zn has the effect of causing embrittlement of ferrite, extending the tool life, and improving the surface roughness. If less than 0.0005%, this effect cannot be observed, while even if added over 0.5%, the effect is saturated in the point of the mechanical properties, so this was made the upper limit.

Ti also forms carbonitrides and strengthens the steel. Further, it is a deoxygenizing element and can form soft oxides to improve the machinability. At 0.0005% or less, that effect is not observed, while even if added over 0.1%, the effect becomes saturated. Further, Ti forms nitrides even at a high temperature and suppresses the growth of austenite grains. Therefore, the upper limit was made 0.1%. Further, Ti bonds with N to form TiN, but TiN is a hard substance and reduces the machinability. Further, it reduces the amount of N is required for producing BN effective for improving machinability. Therefore, the amount of addition of Ti is preferably made 0.010% or less.

Ca is a deoxygenizing element. It not only produces soft oxides and improves the machinability, but also dissolves in the MnS and reduces the transformation ability and acts to suppress elongation of the MnS shape even with rolling and hot forging. Therefore, it is an element effective for reducing anisotropy. If less than 0.0002%, the effect is not remarkable, while even if adding 0.005% or more, not only does the yield become extremely poor, but also a large amount of hard CaO is produced and conversely the machinability is reduced. Therefore, the range is defined as 0.0002 to 0.005%.

Zr is a deoxygenizing element and produces oxides. The oxides form nuclei for precipitation of MnS and are effective for the fine, uniform diffusion of MnS. Further, it dissolves in MnS to reduce the deformation ability and acts to suppress elongation of the MnS shape even with hot rolling or hot forging. Therefore, it is an element effective for reduction of anisotropy. If less than 0.0005%, the effect is not remarkable, while even if added in 0.1% or more, not only does the yield become extremely poor, but also large amounts of $ZrO_2$, ZrS, etc. are produced and conversely the machinability is reduced. Therefore, the range of addition was defined as 0.0005 to 0.1%. Note that when trying to finely disperse MnS, compound addition of Zr and Ca is preferable.

Mg is a deoxygenizing element and produces oxides. The oxides form nuclei for precipitation of MnS and are effective for the fine, uniform dispersion of MnS. It is an element effective for reduction of anisotropy. If less than 0.0003%, the effect is not remarkable, while even if added in 0.005% or more, not only does the yield become extremely poor, but also the effect is saturated. Therefore, the range of addition was defined as 0.0003 to 0.005%.

Te is an element for improving the machinability. Further, it produces MnTe or works with MnS to reduce the deformability of MnS and suppress the elongation of the MnS shapes. Therefore, it is an element effective for reducing the anisotropy. The effect is not observed if less than 0.0003%, while the effect becomes saturated if over 0.05%.

Bi and Pb are elements effective for improving machinability. Their effects are not observed at 0.005% or less, while even if added in amounts over 0.5%, not only do the effects of improvement of machinability become saturated, but also the hot forgeability drops and easily becomes a cause of defects.

Al is a deoxygenizing element and forms $Al_2O_3$ or AlN in steel, However, $Al_2O_3$ is hard, so becomes a cause of tool damage at the time of cutting and promotes wear. Therefore, the limit was made 0.015% where a large amount of $Al_2O_3$ is not produced. In particular, when giving priority to tool life, the limit is preferably made 0.005% or less.

Further, in the present invention, when giving priority to avoiding trouble in quenching rather than machinability, it is possible to reduce the amount of B in the allowable range of machinability. For example, by making the amount of B in the composition of ingredients defined by the present invention 0.0005 to 0.005% and making the amount of S 0.5 to 1.0 wt %, it is possible to obtain steel superior in machinability. This is because if B is present in a large amount, the dissolved B remains, so the hardened layer becomes too deep due to the carburization quenching or other heat treatment, so by increasing the strain in the part performance or making the hardened parts brittle, it is possible to prevent various types of trouble such as quench cracks. Further, in the present invention, in cold forging, wire drawing, and other methods of working other than machining seen in free-machining steel, MnS easily becomes starting points of fractures. The mechanical properties sometimes are reduced due to the occurrence of cracks. Therefore, to secure the minimum extent of machinability of the free-machining steel, it is possible to suppress the amount of S to 0.03 to 0.5 wt % so as to suppress cold forging and high frequency surface layer cracks.

Next, the method of production of steel for causing fine dispersion of MnS and BN in the above way will be explained.

The fine dispersion of sulfides having MnS as a main ingredient and having BN compound precipitated is effective for improvement of the machinability. To get the sulfides finely dispersed, it is necessary to control the precipitation of the sulfides having MnS as a main ingredient and having BN compound precipitated. For this control, it is necessary to define the range of cooling rate during casting. With a cooling rate of 10° C./min or less, the solidification is too slow and the sulfides having MnS as a main ingredient and having BN compound precipitated end up becoming coarser and can no longer be finely dispersed. With a cooling rate of 100° C./min or more, the density of the fine sulfides produced becomes saturated, the hardness of the billet rises, and the danger of cracks increases. The cooling rate can be easily obtained by controlling the size of the cross-section of the casting mold, the casting speed, etc. to suitable values. This may be applied to the continuous casting method and the pouring method.

The "cooling rate" referred to here means the speed at the time of cooling from the liquid phase line temperature to the solid phase line temperature in the billet thickness direction Q part. The cooling rate is found by calculation by the following equation from the secondary dendrite arm spacing of the solidified structure in the billet thickness direction after solidification.

$$Rc = \left(\frac{\lambda 2}{770}\right)^{\frac{1}{0.41}}$$

where, Rc: cooling rate (° C./min)

λ2: secondary dendrite arm spacing (μm)

That is, since the secondary dendrite arm spacing changes depending on the cooling conditions, it is possible to measure this to confirm the controlled cooling rate.

BN dissolves in austenite at 1000° C. or more. At a temperature of 1000° C. or less, the BN precipitated in the process from the casting to the rough rolling remains at the grain boundaries and compound precipitation as sulfides having MnS as a main ingredient and having BN compound precipitated is not possible. By rolling at a temperature of 1000° C. or more in the finishing (final) rolling step at the hot rolling, the once dissolved BN easily compound precipitates as nuclei for precipitation of MnS sulfides. If finally rolling at 1000° C. or less, compound precipitation of sulfides mainly comprised of BN and MnS no longer easily occurs.

Next, the method of production for obtaining a microstructure of a pearlite area ratio of 5% or less in the present invention will be explained.

The behavior of formation of built-up edges on tools has a great effect on the cut surface roughness. Inherently, dynamatically speaking, the area right above the cutting tool is the harshest environment for materials and fracture/breakage of materials easily occur, so there should be no formation of built-up edges. In practice, built-up edges are formed due to the powerful adhesion between the tool and cut material and the structural uniformity of the cut material. Therefore, it is considered important to greatly increase the homogeneity of the microstructure of the material. As a result, the inventors discovered that the pearlite distribution, which had been considered almost irrelevant up to now, is greatly related to the homogeneity of the microstructure.

Here, the "pearlite" means a structure appearing black when etching a mirror polished surface by Nytal. "Pearlite" strictly speaking indicates ferrite and plate-shaped cementite alternately arranged. Under an opticalmicroscope, a single crystal grain appears to be seen. Further, as shown in FIG. 1, with production by normal rolling and cooling, the pearlite grains precipitate in band shapes (hereinafter referred to as "pearlite bands"). This pearlite differs in mechanical properties from the single phase ferrite of the matrix, so the deformation and fracture near the cutting edge become uneven and further the growth of built-up edges is augmented.

Therefore, the inventors adjusted the steel ingredients or thermal history to suppress the area ratio of pearlite grains of a grain size of 1 μm or more in an observation field of a measurement field of 4 $mm^2$ and investigate the critical region where a good surface roughness is obtained, whereupon they learned that deterioration of the surface roughness is suppressed by making the area ratio of pearlite grains of 1 μm or more a ratio of not more than 5%. FIG. 2 shows the relationship between the area ratio of pearlite and the surface roughness.

As shown in FIG. 1, it is learned that the free-machining steel according to the present invention has extremely little of such a structure appearing black. In the present invention, the result is strictly speaking tempered martensite or tempered bainite. The possibility cannot be denied that the carbides are not pearlite (in other words, a striped structure of plate-shaped cementite and ferrite), but cementite grains. However, here, such ferrous carbides will be referred to all together as "pearlite".

Next, the method of production of free-machining steel according to the present invention will be explained.

[Thermal history quenching: 0.5° C./s from temperature of $A_3$ point or more to 550° C. or less]

In the present invention, as the thermal history after hot rolling, it is important to cool from a temperature of above the $A_3$ point after hot rolling to 550° C. or less by a cooling rate of at least 0.5° C./sec.

In the past, the practice had been to rapidly cool so-called low carbon free-machining steel. Low carbon free-machining steel is low in amount of C, so even with quenching, there is little change in hardness. Therefore, there is no effect on the strength/toughness due to conventional "quenching and tempering" and the fixed idea that this is not necessary for free-machining steel is not bound to. However, when pursuing homogeneity of the quality considering the nature of cutting, it is sufficient to rapidly cool from the $A_3$ point so as to freeze movement of C in the steel and suppress the generation of coarse cementite and pearlite occurring due to the transformation at the time of air cooling. In this case, since the hardening due to quenching is not the objective, even if not becoming a quenched structure having a martensite structure, it is sufficient to freeze movement of C in the steel and prevent the generation of coarse cementite or pearlite. Therefore, as shown in FIG. 3, it is necessary to cool from the $A_3$ point to 550° C. or less by a rate of 0.5° C./sec or more. When the content of the elements improving quenchability is low, a cooling rate of at least 1° C./s is preferable. If the temperature after cooling exceeds 550° C. or the cooling rate is slower than 0.5, coarse pearlite is produced. In general, this is precipitated in band shapes referred to as pearlite bands. Naturally, if the alloy elements are added in large amounts as with stainless steel, even if the cooling rate is slower than 0.5° C./sec, pearlite bands are not formed. Here, however, general free-machining steel is envisioned, so the cooling rate is defined as 0.5° C./sec.

Next, in the present invention, after the above rapid cooling, heat treatment for holding at a temperature of 750° C. or less may be performed to make the structure of the free-machining steel more homogeneous.

In the actual production process, to further increase the stability of the product, while the amount of C is small, it is preferable to reduce the variation in hardness in the steel. Therefore, it is possible to again hold the steel at a high temperature so as to reduce the variation in the material. First, to suppress the coarse pearlite, it is important to rapidly cool from a temperature of the $A_3$ point or more to 550° C. or less where coarse pearlite is no longer produced. On top of this, as shown in FIG. 4, it is possible to retain the steel again at a predetermined temperature $T_2$° C. to adjust the hardness to one satisfying user requirements and reduce the variation in hardness as well. By heating and retention at a temperature of not more than 750° C., the steel is adjusted to a hardness satisfying the requirements of a user.

Regarding the holding temperature $T_2$° C., the holding temperature and the holding time should be determined so as to give a hardness satisfying the demands of the users. However, if the holding temperature $T_2$° C. exceeds 750° C., transformation to austenite starts, so if the cooling rate at cooling again is slow, pearlite bands end up being produced. Therefore, the holding temperature $T_2$° C. was made 750° C. or less. Further, wire drawing or other secondary working is often applied at a later step, so it is preferable to adjust the temperature $T_2$° C. so as to give a hardness suitable for handling in the later step. Regarding the holding time, industrially speaking, at 3 minutes or less, there is almost no change in hardness etc. compared with almost no holding, so the time is preferably made at least this.

Note that in industrial production, the temperature becomes uneven even in the steel due to the rolling or forging dimensions etc., so the holding time at the temperature T1° C. of up to 550° C. after rapid cooling for preventing coarse pearlite should also be considered. By holding at a temperature T1° C. of 550° C. or less after rapid cooling for preferably at least 5 minutes, uniform ferrite transformation can be promoted without relation to the dimensions of the material or segregation bands. By doing this, after this, even if raising the temperature to the holding temperature $T_2$° C. (≦750° C.)., coarse pearlite or pearlite bands will not be generated. Conversely, when the dimensions after rolling or forging are large, if the holding time at 550° C. or less is shorter than 1 minute, the internal transformation does not end, so coarse pearlite or pearlite bands are produced if holding at a temperature of 550° C. or more after that.

EXAMPLES

Example 1

The effect of the present invention will be explained by examples. Among the test materials shown in Table 1, Table 2 (continuation 1 of Table 1), Table 3 (continuation 2 of Table 1), Table 4 (continuation 3 of Table 1), Table 5 (continuation 4 of Table 1), and Table 6 (continuation 5 of Table 1), No. 13 was melted in a 270 t converter, while the rest were melted in a 2 t vacuum melting furnace, then the materials were bloomed into billets and rolled to ϕ60 mm.

In the section on heat treatment in the tables, the examples marked as "Normal." are held at 920° C. for at least 10 min and then air-cooled. The examples of the invention marked as "QT" are inserted into a water tank at the rear end of the rolling line and rapidly cooled from 920° C., then held by annealing at 700° C. for at least 1 hour. The pearlite area ratio was adjusted by this. In the invention examples, steels with a low amount of C can be reduced in area ratio of pearlite even with normalization.

The machinability of the material shown in Examples 1 to 81 of Table 1 to Table 6 was evaluated by a drilling test of the conditions shown in Table 7. The machinability was evaluated at the maximum cutting speed (so-called VL1000, unit m/min) enabling cutting up to a cumulative hole depth of 1000 mm.

Figure 7B:
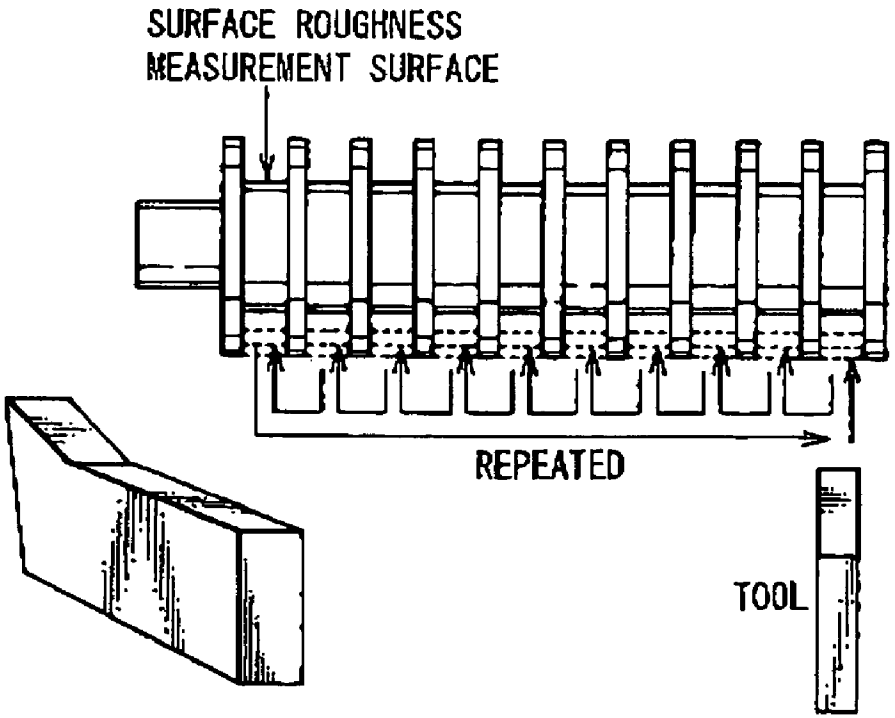
FIG. 7 is a view of a plunge cutting method.
Figure 7A:
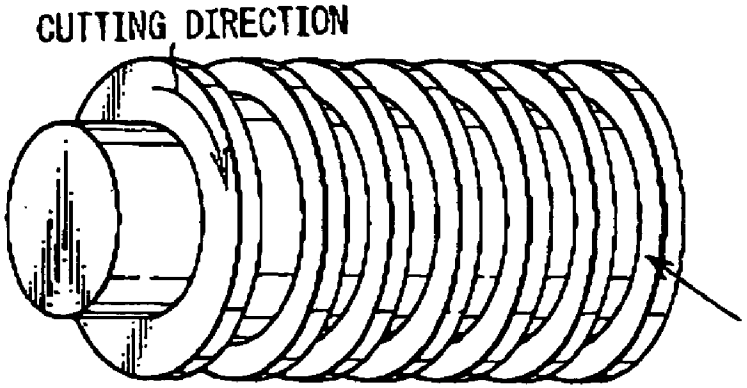

The cut surface roughness showing the surface quality in the cutting was evaluated. The cutting conditions are shown in Table 8 and the method of evaluation (hereinafter referred to as a "plunge cutting test") is shown in FIG. 7(*a*) and FIG. 7(*b*). In the plunge cutting test, a tool is repeatedly used for cutting for a short period. With one cutting operation, the tool does not move in the longitudinal direction of the machined material, but moves toward the center of the rotating cut material, so the tool is pulled back after a short time of cutting. The shape is basically the shape of the built-up edge of the tool transferred to the surface of the cut material. The surface roughness of the cut surface transferred is affected by formation of the built-up edges or the wear loss of the tool. The surface roughness was measured by a surface roughness meter. The 10-point surface roughness Rz (μm) was used as an indicator of the surface roughness.

Invention Examples 1 to 7 were all superior in drill life compared with Comparative Examples 76 to 81 and were good in surface roughness in plunge cutting. This is believed to be because the B caused the ferrite to be locally made brittle and the surface was smoothly created, so a good surface roughness was obtained.

The effect of improvement of surface roughness was remarkable when S was over 0.5% but an effect was seen in chip disposal even when the amount of S was smaller.

Further, an effect was recognized even when the ratio of Mn and S was the 3 or so often seen in conventional steel, but if Mn/S is made smaller, the tool life is improved more and the surface roughness is also improved. The reason is that in an environment with a large amount of B added, the fine MnS finely disperses even in the ferrite and effectively functions for both the lubrication effect and the embrittlement effect. However, if Mn/S is too small such as with Example 80, FeS is produced, so roll cracks occur. In the evaluation of the present invention, Example 70 had roll cracks, so could not be evaluated for machinability etc. at all, so the results of evaluation were not recorded in the tables.

Even if changing the amount of C somewhat (Tables 1 to 6 and Examples 37 to 75), a good tool life and cut surface roughness could be obtained by adding a large amount of B and by controlling the area ratio of pearlite.

Note that regarding the chip disposal, it is preferable that the chips be small in curvature at the time of curling or that they be broken. Therefore, chips extending long curled 3 or more turns by a radius of curvature over 20 mm are deemed defective. Chips with a large number of turns and small radius of curvature or chips with a large radius of curvature and length not reaching 100 mm are deemed good.

TABLE 1

| | | Chemical ingredients wt % | | | | | | | | | | | | | | | | |
|---|---|---|---|---|---|---|---|---|---|---|---|---|---|---|---|---|---|---|
| Ex. | Class | C | Si | Mn | P | S | B | total-N | total-O | V | Nb | Cz | Mo | W | Ni | Cu | Sn | Zn |
| 1 | Inv. ex. | 0.023 | 0.004 | 1.69 | 0.072 | 0.52 | 0.0080 | 0.0079 | 0.0187 | | | | | | | | | |
| 2 | Inv. ex. | 0.011 | 0.015 | 2.05 | 0.077 | 0.72 | 0.0067 | 0.0061 | 0.0174 | | | | | | | | | |
| 3 | Inv. ex. | 0.055 | 0.008 | 1.64 | 0.078 | 0.55 | 0.0094 | 0.0096 | 0.0202 | | | | | | | | | |
| 4 | Inv. ex. | 0.058 | 0.013 | 2.36 | 0.077 | 0.75 | 0.0098 | 0.0102 | 0.0152 | | | | | | | | | |
| 5 | Inv. ex. | 0.101 | 0.009 | 1.62 | 0.080 | 0.52 | 0.0062 | 0.0055 | 0.0153 | | | | | | | | | |
| 6 | Inv. ex. | 0.090 | 0.009 | 2.14 | 0.088 | 0.75 | 0.0110 | 0.0127 | 0.0206 | | | | | | | | | |
| 7 | Inv. ex. | 0.118 | 0.005 | 1.71 | 0.076 | 0.53 | 0.0050 | 0.0040 | 0.0164 | | | | | | | | | |
| 8 | Inv. ex. | 0.117 | 0.007 | 2.10 | 0.079 | 0.73 | 0.0109 | 0.0116 | 0.0175 | | | | | | | | | |
| 9 | Inv. ex. | 0.167 | 0.004 | 1.70 | 0.083 | 0.55 | 0.0089 | 0.0090 | 0.0200 | | | | | | | | | |
| 10 | Inv. ex. | 0.174 | 0.007 | 2.19 | 0.072 | 0.75 | 0.0216 | 0.0126 | 0.0200 | | | | | | | | | |
| 11 | Inv. ex. | 0.065 | 0.009 | 1.66 | 0.089 | 0.52 | 0.0129 | 0.0142 | 0.0166 | | | | | | | | | |
| 12 | Inv. ex. | 0.055 | 0.004 | 1.70 | 0.074 | 0.58 | 0.0130 | 0.0143 | 0.0171 | | | | | | | | | |
| 13 | Inv. ex. | 0.057 | 0.012 | 1.75 | 0.078 | 0.57 | 0.0133 | 0.0147 | 0.0169 | | | | | | | | | |
| 14 | Inv. ex. | 0.058 | 0.013 | 1.84 | 0.084 | 0.59 | 0.0127 | 0.0139 | 0.0056 | | | | | | | | | |
| 15 | Inv. ex. | 0.057 | 0.005 | 1.76 | 0.078 | 0.56 | 0.0052 | 0.0042 | 0.0157 | 0.11 | | | | | | | | |
| 16 | Inv. ex. | 0.053 | 0.005 | 1.70 | 0.078 | 0.60 | 0.0094 | 0.0096 | 0.0155 | | 0.032 | | | | | | | |

TABLE 1-continued

| | | Chemical ingredients wt % | | | | | | | | | | | | | | | | |
|---|---|---|---|---|---|---|---|---|---|---|---|---|---|---|---|---|---|---|
| Ex. | Class | C | Si | Mn | P | S | B | total-N | total-O | V | Nb | Cz | Mo | W | Ni | Cu | Sn | Zn |
| 17 | Inv. ex. | 0.055 | 0.013 | 1.72 | 0.083 | 0.55 | 0.0131 | 0.0146 | 0.0207 | | | 0.34 | | | | | | |
| 18 | Inv. ex. | 0.050 | 0.014 | 1.91 | 0.078 | 0.58 | 0.0105 | 0.0111 | 0.0174 | | | | 0.21 | | | | | |
| 19 | Inv. ex. | 0.055 | 0.010 | 1.68 | 0.089 | 0.56 | 0.0051 | 0.0042 | 0.0196 | | | | | 0.11 | 0.48 | | | |
| 20 | Inv. ex. | 0.057 | 0.013 | 1.49 | 0.082 | 0.51 | 0.0128 | 0.0131 | 0.0182 | | | | | | | 0.21 | | |
| 21 | Inv. ex. | 0.057 | 0.010 | 1.77 | 0.072 | 0.58 | 0.0053 | 0.0043 | 0.0164 | | | | | | | | 0.36 | |
| 22 | Inv. ex. | 0.050 | 0.005 | 1.75 | 0.087 | 0.54 | 0.0069 | 0.0064 | 0.0153 | | | | | | | | | 0.0040 |
| 23 | Inv. ex. | 0.054 | 0.012 | 1.57 | 0.080 | 0.53 | 0.0099 | 0.0104 | 0.0079 | | | | | | | | | |
| 24 | Inv. ex. | 0.050 | 0.009 | 1.81 | 0.089 | 0.55 | 0.0075 | 0.0073 | 0.0052 | | | | | | | | | |
| 25 | Inv. ex. | 0.050 | 0.014 | 1.80 | 0.079 | 0.58 | 0.0081 | 0.0079 | 0.0185 | | | | | | | | | |
| 26 | Inv. ex. | 0.057 | 0.014 | 1.72 | 0.081 | 0.53 | 0.0083 | 0.0083 | 0.0208 | | | | | | | | | |
| 27 | Inv. ex. | 0.051 | 0.014 | 1.76 | 0.078 | 0.60 | 0.0112 | 0.0119 | 0.0170 | | | | | | | | | |
| 28 | Inv. ex. | 0.055 | 0.003 | 1.67 | 0.090 | 0.55 | 0.0101 | 0.0107 | 0.0191 | | | | | | | | | |
| 29 | Inv. ex. | 0.050 | 0.003 | 1.83 | 0.089 | 0.56 | 0.078 | 0.0077 | 0.0210 | | | | | | | | | |
| 30 | Inv. ex. | 0.057 | 0.013 | 1.70 | 0.073 | 0.59 | 0.0080 | 0.0079 | 0.0059 | | | | | | | | | |
| 31 | Inv. ex. | 0.022 | 0.010 | 0.98 | 0.079 | 0.54 | 0.0097 | 0.0101 | 0.0190 | | | | | | | | | |
| 32 | Inv. ex. | 0.020 | 0.007 | 1.63 | 0.074 | 0.76 | 0.0123 | 0.0134 | 0.0168 | | | | | | | | | |
| 33 | Inv. ex. | 0.059 | 0.007 | 1.43 | 0.089 | 0.59 | 0.0125 | 0.0137 | 0.0184 | | | | | | | | | |
| 34 | Inv. ex. | 0.052 | 0.003 | 1.64 | 0.085 | 0.73 | 0.0063 | 0.0057 | 0.0207 | | | | | | | | | |
| 35 | Inv. ex. | 0.099 | 0.015 | 1.24 | 0.074 | 0.52 | 0.0131 | 0.0145 | 0.0190 | | | | | | | | | d |

TABLE 2

(continuation 1 of Table 1)

| | | Chemical ingredients (wt %) | | | | | | | | | Heat | Pearlite area | VL1000 | Surface roughness | Chip |
|---|---|---|---|---|---|---|---|---|---|---|---|---|---|---|---|
| Ex. | Class | Ti | Ca | Zr | Mg | Te | Bi | Pb | Al | Mn/S | treatment | ratio (%) | m/min | Rz (μm) | disposal |
| 1 | Inv. ex. | | | | | | | | 0.0011 | 3.26 | Normal. | 1.5 | 147 | 10.5 | G |
| 2 | Inv. ex. | | | | | | | | 0.0013 | 2.84 | Normal. | 0.6 | 155 | 10.4 | G |
| 3 | Inv. ex. | | | | | | | | 0.0023 | 2.98 | QT | 1.9 | 144 | 7.3 | G |
| 4 | Inv. ex. | | | | | | | | 0.0018 | 3.13 | QT | 0.7 | 157 | 6.6 | G |
| 5 | Inv. ex. | | | | | | | | 0.0013 | 3.13 | QT | 0.7 | 142 | 7.8 | G |
| 6 | Inv. ex. | | | | | | | | 0.0021 | 2.83 | QT | 2.0 | 152 | 6.2 | G |
| 7 | Inv. ex. | | | | | | | | 0.0019 | 3.24 | QT | 2.0 | 147 | 6.6 | G |
| 8 | Inv. ex. | | | | | | | | 0.0020 | 2.88 | QT | 1.4 | 157 | 7.4 | G |
| 9 | Inv. ex. | | | | | | | | 0.0017 | 3.11 | QT | 2.6 | 141 | 6.8 | G |
| 10 | Inv. ex. | | | | | | | | 0.0013 | 2.91 | QT | 0.6 | 145 | 6.5 | G |
| 11 | Inv. ex. | | | | | | | | 0.0020 | 3.19 | Normal. | 5.5 | 130 | 10.8 | G |
| 12 | Inv. ex. | | | | | | | | 0.0017 | 2.92 | QT | 2.3 | 131 | 6.4 | G |
| 13 | Inv. ex. | | | | | | | | 0.0026 | 3.08 | QT | 2.7 | 126 | 6.3 | G |
| 14 | Inv. ex. | | | | | | | | 0.0024 | 3.14 | QT | 0.8 | 145 | 7.5 | G |
| 15 | Inv. ex. | | | | | | | | 0.0025 | 3.13 | QT | 2.6 | 146 | 7.7 | G |
| 16 | Inv. ex. | | | | | | | | 0.0023 | 2.84 | QT | 0.7 | 144 | 6.6 | G |
| 17 | Inv. ex. | | | | | | | | 0.0012 | 3.14 | QT | 2.8 | 147 | 6.8 | G |
| 18 | Inv. ex. | | | | | | | | 0.0025 | 3.29 | QT | 0.5 | 145 | 7.5 | G |
| 19 | Inv. ex. | | | | | | | | 0.0025 | 3.01 | QT | 1.5 | 147 | 7.0 | G |
| 20 | Inv. ex. | | | | | | | | 0.0023 | 2.89 | QT | 2.5 | 145 | 7.0 | G |
| 21 | Inv. ex. | | | | | | | | 0.0016 | 3.03 | QT | 3.0 | 146 | 6.9 | G |
| 22 | Inv. ex. | | | | | | | | 0.0011 | 3.24 | QT | 0.8 | 143 | 7.2 | G |
| 23 | Inv. ex. | 0.026 | | | | | | | 0.0030 | 2.96 | QT | 1.0 | 143 | 8.0 | G |
| 24 | Inv. ex. | | 0.0037 | | | | | | 0.0028 | 3.26 | QT | 1.3 | 145 | 7.2 | G |
| 25 | Inv. ex. | | | 0.0037 | | | | | 0.0021 | 3.09 | QT | 3.0 | 144 | 6.9 | G |
| 26 | Inv. ex. | | | | 0.0025 | | | | 0.0027 | 3.25 | QT | 2.9 | 146 | 7.7 | G |
| 27 | Inv. ex. | | | | | 0.0030 | | | 0.0022 | 2.94 | QT | 1.0 | 144 | 7.9 | G |
| 28 | Inv. ex. | | | | | | 0.16 | | 0.0012 | 3.02 | QT | 1.2 | 170 | 7.3 | G |
| 29 | Inv. ex. | | | | | | | 0.283 | 0.0018 | 3.29 | QT | 1.3 | 170 | 6.4 | G |
| 30 | Inv. ex. | | | | | | | | 0.0153 | 2.88 | QT | 0.8 | 128 | 7.1 | G |
| 31 | Inv. ex. | | | | | | | | 0.0029 | 1.82 | Normal. | 1.4 | 154 | 10.2 | G |
| 32 | Inv. ex. | | | | | | | | 0.0030 | 2.16 | Normal. | 1.4 | 165 | 11.7 | G |
| 33 | Inv. ex. | | | | | | | | 0.0013 | 2.42 | QT | 2.0 | 156 | 3.9 | G |
| 34 | Inv. ex. | | | | | | | | 0.0020 | 2.25 | QT | 1.4 | 167 | 4.5 | G |
| 35 | Inv. ex. | | | | | | | | 0.0027 | 2.39 | QT | 0.7 | 153 | 4.1 | G |

TABLE 3

(continuation 2 of Table 1)

| | | Chemical ingredients wt % | | | | | | | | | | | | | | | | |
|---|---|---|---|---|---|---|---|---|---|---|---|---|---|---|---|---|---|---|
| Ex. | Class | C | Si | Mn | P | S | B | total-N | total-O | V | Nb | Cr | Mo | W | Ni | Cu | Sn | Zn |
| 36 | Inv. ex. | 0.091 | 0.006 | 1.54 | 0.079 | 0.77 | 0.0057 | 0.0050 | 0.0168 | | | | | | | | | |
| 37 | Inv. ex. | 0.115 | 0.013 | 1.34 | 0.072 | 0.56 | 0.0202 | 0.0107 | 0.0194 | | | | | | | | | |
| 38 | Inv. ex. | 0.118 | 0.011 | 1.61 | 0.083 | 0.76 | 0.0090 | 0.0091 | 0.0297 | | | | | | | | | |
| 39 | Inv. ex. | 0.167 | 0.007 | 1.36 | 0.089 | 0.57 | 0.0052 | 0.0042 | 0.0166 | | | | | | | | | |
| 40 | Inv. ex. | 0.171 | 0.006 | 1.42 | 0.089 | 0.71 | 0.0097 | 0.0100 | 0.0191 | | | | | | | | | |
| 41 | Inv. ex. | 0.064 | 0.007 | 1.15 | 0.086 | 0.59 | 0.0121 | 0.0132 | 0.0208 | | | | | | | | | |
| 42 | Inv. ex. | 0.053 | 0.003 | 1.00 | 0.074 | 0.53 | 0.0104 | 0.0110 | 0.0172 | | | | | | | | | |
| 43 | Inv. ex. | 0.052 | 0.014 | 1.13 | 0.077 | 0.58 | 0.0095 | 0.0098 | 0.0160 | | | | | | | | | |
| 44 | Inv. ex. | 0.056 | 0.014 | 1.04 | 0.089 | 0.54 | 0.0082 | 0.0081 | 0.0109 | | | | | | | | | |
| 45 | Inv. ex. | 0.053 | 0.013 | 1.06 | 0.077 | 0.59 | 0.0065 | 0.0059 | 0.0172 | 0.10 | | | | | | | | |
| 46 | Inv. ex. | 0.050 | 0.007 | 1.14 | 0.088 | 0.57 | 0.0115 | 0.0124 | 0.0181 | | 0.038 | | | | | | | |
| 47 | Inv. ex. | 0.053 | 0.009 | 1.26 | 0.082 | 0.53 | 0.0094 | 0.0097 | 0.0185 | | | 0.67 | | | | | | |
| 48 | Inv. ex. | 0.058 | 0.006 | 1.13 | 0.076 | 0.54 | 0.0056 | 0.0047 | 0.0173 | | | | 0.22 | | | | | |
| 49 | Inv. ex. | 0.059 | 0.002 | 1.20 | 0.090 | 0.60 | 0.0090 | 0.0091 | 0.0192 | | | | | | 0.48 | | | |
| 50 | Inv. ex. | 0.057 | 0.005 | 1.31 | 0.082 | 0.56 | 0.0055 | 0.0046 | 0.0171 | | | | | | | 0.12 | | |
| 51 | Inv. ex. | 0.051 | 0.002 | 1.15 | 0.070 | 0.57 | 0.0076 | 0.0072 | 0.0186 | | | | | | | | 0.24 | 0.0027 |
| 52 | Inv. ex. | 0.050 | 0.012 | v25 | 0.079 | 0.55 | 0.0085 | 0.0085 | 0.0157 | | | | | | | | | |
| 53 | Inv. ex. | 0.055 | 0.014 | 1.26 | 0.074 | 0.60 | 0.0109 | 0.0116 | 0.0058 | | | | | | | | | |
| 54 | Inv. ex. | 0.055 | 0.003 | 0.99 | 0.073 | 0.52 | 0.0070 | 0.0066 | 0.0103 | | | | | | | | | |
| 55 | Inv. ex. | 0.059 | 0.011 | 1.09 | 0.087 | 0.51 | 0.0129 | 0.0142 | 0.0175 | | | | | | | | | |
| 56 | Inv. ex. | 0.052 | 0.003 | 1.07 | 0.082 | 0.59 | 0.0063 | 0.0057 | 0.0187 | | | | | | | | | |
| 57 | Inv. ex. | 0.056 | 0.010 | 1.17 | 0.075 | 0.53 | 0.063 | 0.0057 | 0.0165 | | | | | | | | | |
| 58 | Inv. ex. | 0.051 | 0.004 | 1.27 | 0.072 | 0.53 | 0.0126 | 0.0138 | 0.0189 | | | | | | | | | |
| 59 | Inv. ex. | 0.056 | 0.010 | 1.12 | 0.080 | 0.56 | 0.0123 | 0.0134 | 0.0173 | | | | | | | | | |
| 60 | Inv. ex. | 0.052 | 0.011 | 1.03 | 0.087 | 0.53 | 0.0113 | 0.0121 | 0.0087 | | | | | | | | | |
| 61 | Inv. ex. | 0.056 | 0.008 | 1.46 | 0.079 | 0.54 | 0.0087 | 0.0100 | 0.0049 | | | | | | | | | |
| 62 | Inv. ex. | 0.051 | 0.009 | 1.65 | 0.077 | 0.56 | 0.0089 | 0.0099 | 0.0045 | | | | | | | | | |
| 63 | Inv. ex. | 0.056 | 0.006 | 1.45 | 0.082 | 0.54 | 0.0098 | 0.0099 | 0.0020 | | | | | | | | | |
| 64 | Inv. ex. | 0.061 | 0.007 | 1.40 | 0.081 | 0.57 | 0.0089 | 0.0091 | 0.0123 | | | | | | | | | |
| 65 | Inv. ex. | 0.071 | 0.011 | 1.10 | 0.002 | 0.55 | 0.0087 | 0.0095 | 0.0110 | | | | | | | | | |
| 66 | Inv. ex. | 0.060 | 0.010 | 1.20 | 0.078 | 0.60 | 0.0103 | 0.0124 | 0.0112 | | | | | | | | | |
| 67 | Inv. ex. | 0.060 | 0.009 | 1.06 | 0.077 | 0.53 | 0.0110 | 0.0121 | 0.0100 | | | | | | | | | |
| 68 | Inv. ex. | 0.060 | 0.009 | 1.08 | 0.076 | 0.54 | 0.0092 | 0.0112 | 0.0101 | | | | | | | | | |
| 69 | Inv. ex. | 0.070 | 0.008 | 1.40 | 0.086 | 0.56 | 0.0088 | 0.0095 | 0.0157 | | | | | | | | | |
| 70 | Inv. ex. | 0.061 | 0.010 | 1.53 | 0.077 | 0.61 | 0.0104 | 0.0124 | 0.0058 | | | | | | | | | d |
| 71 | Inv. ex. | 0.060 | 0.060 | 1.35 | 0.077 | 0.54 | 0.0110 | 0.0122 | 0.0189 | | | | | | | | | |

TABLE 4

(continuation 3 of Table 1)

| | | Chemical ingredients (wt %) | | | | | | | | | Heat | Pearlite area | VL1000 | Surface roughness | Chip |
|---|---|---|---|---|---|---|---|---|---|---|---|---|---|---|---|
| Ex. | Class | Ti | Ca | Zr | Mg | Te | Bi | Pb | Al | Mn/S | treatment | ratio (%) | m/min | Rz (μm) | disposal |
| 36 | Inv. ex. | | | | | | | | 0.0028 | 2.01 | QT | 3.0 | 168 | 3.5 | G |
| 37 | Inv. ex. | | | | | | | | 0.0018 | 2.39 | QT | 2.2 | 154 | 3.4 | G |
| 38 | Inv. ex. | | | | | | | | 0.0014 | 2.11 | QT | 2.1 | 170 | 3.7 | G |
| 39 | Inv. ex. | | | | | | | | 0.0024 | 2.39 | QT | 0.5 | 156 | 3.5 | G |
| 40 | Inv. ex. | | | | | | | | 0.0027 | 2.00 | QT | 0.7 | 168 | 3.9 | G |
| 41 | Inv. ex. | | | | | | | | 0.0014 | 1.95 | Normal. | 5.2 | 135 | 3.9 | G |
| 42 | Inv. ex. | | | | | | | | 0.0023 | 1.90 | QT | 2.5 | 131 | 3.6 | G |
| 43 | Inv. ex. | | | | | | | | 0.0029 | 1.95 | QT | 2.0 | 133 | 3.1 | G |
| 44 | Inv. ex. | | | | | | | | 0.0016 | 1.92 | QT | 1.0 | 155 | 3.4 | G |
| 45 | Inv. ex. | | | | | | | | 0.0015 | 1.82 | QT | 2.8 | 156 | 3.7 | G |
| 46 | Inv. ex. | | | | | | | | 0.0026 | 2.00 | QT | 1.9 | 155 | 3.3 | G |
| 47 | Inv. ex. | | | | | | | | 0.0012 | 2.39 | QT | 1.4 | 156 | 3.7 | G |
| 48 | Inv. ex. | | | | | | | | 0.0026 | 2.09 | QT | 0.6 | 155 | 3.6 | G |
| 49 | Inv. ex. | | | | | | | | 0.0012 | 2.00 | QT | 2.8 | 154 | 4.1 | G |
| 50 | Inv. ex. | | | | | | | | 0.0030 | 2.31 | QT | 1.4 | 156 | 4.2 | G |
| 51 | Inv. ex. | | | | | | | | 0.0019 | 2.02 | QT | 2.6 | 155 | 3.3 | G |
| 52 | Inv. ex. | | | | | | | | 0.0029 | 2.27 | QT | 0.8 | 153 | 4.8 | G |
| 53 | Inv. ex. | 0.036 | | | | | | | 0.0016 | 2.12 | QT | 1.3 | 156 | 4.7 | G |
| 54 | Inv. ex. | | 0.0033 | | | | | | 0.0017 | 1.89 | QT | 2.5 | 156 | 4.5 | G |
| 55 | Inv. ex. | | | 0.0035 | | | | | 0.0024 | 2.14 | QT | 2.1 | 154 | 3.0 | G |
| 56 | Inv. ex. | | | | 0.0020 | | | | 0.0013 | 1.82 | QT | 2.6 | 154 | 4.3 | G |
| 57 | Inv. ex. | | | | | 0.0061 | | | 0.0022 | 2.21 | QT | 2.4 | 154 | 3.6 | G |
| 58 | Inv. ex. | | | | | | 0.16 | | 0.0017 | 2.37 | QT | 2.8 | 182 | 2.6 | G |
| 59 | Inv. ex. | | | | | | | 0.266 | 0.0031 | 2.02 | QT | 2.5 | 189 | 2.2 | G |

TABLE 4-continued (continuation 3 of Table 1)

| Ex. | Class | Chemical ingredients (wt %) Ti | Ca | Zr | Mg | Te | Bi | Pb | Al | Mn/S | Heat treatment | Pearlite area ratio (%) | VL1000 m/min | Surface roughness Rz (μm) | Chip disposal |
|---|---|---|---|---|---|---|---|---|---|---|---|---|---|---|---|
| 60 | Inv. ex. | | | | | | | | 0.0280 | 1.96 | QT | 1.9 | 136 | 3.5 | G |
| 61 | Inv. ex. | | | | | | | | 0.0010 | 2.70 | QT | 2.3 | 146 | 6.5 | G |
| 62 | Inv. ex. | 0.005 | | 0.0009 | | | | | 0.0021 | 2.95 | QT | 3.4 | 145 | 6.4 | G |
| 63 | Inv. ex. | | 0.0022 | 0.0025 | | | | | 0.0010 | 2.68 | QT | 2.9 | 245 | 6.6 | G |
| 64 | Inv. ex. | | 0.0018 | 0.0012 | | | | | 0.0011 | 2.45 | QT | 3.0 | 139 | 6.5 | G |
| 65 | Inv. ex. | | | | | | | | 0.0016 | 2.00 | QT | 2.5 | 172 | 7.0 | G |
| 66 | Inv. ex. | | | 0.0030 | | | | | 0.0015 | 2.00 | QT | 2.8 | 134 | 6.5 | G |
| 67 | Inv. ex. | | | | | | | | 0.0012 | 2.00 | QT | 3.6 | 131 | 8.9 | G |
| 68 | Inv. ex. | | 0.0025 | 0.0015 | | | | | 0.0019 | 2.00 | QT | 2.1 | 130 | 6.1 | G |
| 69 | Inv. ex. | | | | | | | | 0.0016 | 2.50 | QT | 3.9 | 135 | 9.9 | G |
| 70 | Inv. ex. | | | | | | | | 0.0017 | 2.51 | QT | 2.3 | 133 | 7.2 | G |
| 71 | Inv. ex. | | | 0.0025 | | | | | 0.0010 | 2.50 | QT | 3.9 | 132 | 6.5 | G |

TABLE 5

(continuation 4 of Table 1)

| Ex. | Class | Chemical ingredients wt % C | Si | Mn | P | S | B | total-N | tolal-O | V | Nb | Cz | Mo | W | Ni | Cu | Sn | Zn |
|---|---|---|---|---|---|---|---|---|---|---|---|---|---|---|---|---|---|---|
| 72 | Inv. ex. | 0.059 | 0.009 | 1.38 | 0.075 | 0.55 | 0.0092 | 0.0132 | 0.0173 | | | | | | | | | |
| 73 | Inv. ex. | 0.069 | 0.009 | 1.62 | 0.076 | 0.54 | 0.0089 | 0.0095 | 0.0160 | | | | | | | | | |
| 74 | Inv. ex. | 0.062 | 0.006 | 1.80 | 0.090 | 0.60 | 0.0100 | 0.0106 | 0.0181 | | | | | | | | | |
| 75 | Comp. ex. | 0.058 | 0.002 | 1.65 | 0.079 | 0.55 | 0.0110 | 0.0122 | 0.0173 | | | | | | | | | |
| 76 | Comp. ex. | 0.045 | 0.007 | 1.00 | 0.084 | 0.35 | 0.0076 | 0.0074 | 0.0183 | | | | | | | | | |
| 77 | Comp. ex. | 0.050 | 0.005 | 1.79 | 0.074 | 0.59 | 0.0067 | 0.0062 | 0.0180 | | | | | | | | | |
| 78 | Comp. ex. | 0.049 | 0.008 | 0.96 | 0.077 | 0.34 | 0.0129 | 0.0141 | 0.0205 | | | | | | | | | |
| 79 | Comp. ex. | 0.055 | 0.009 | 1.78 | 0.080 | 0.59 | — | 0.0123 | 0.0151 | | | | | | | | | |
| 80 | Comp. ex. | 0.047 | 0.011 | 0.48 | 0.085 | 0.53 | 0.0089 | 0.0090 | 0.0167 | | | | | | | | | |
| 81 | Comp. ex. | 0.048 | 0.008 | 0.93 | 0.089 | 0.53 | — | 0.0139 | 0.0151 | | | | | | | | | |

TABLE 6

(continuation 1 of Table 1)

| Ex. | Class | Chemical ingredients (wt %) Ti | Ca | Zr | Mg | Te | Bi | Pb | Al | Mn/S | Heat treatment | Pearlite area ratio (%) | VL1000 m/min | Surface roughness Rz {μm} | Chip disposal |
|---|---|---|---|---|---|---|---|---|---|---|---|---|---|---|---|
| 72 | Inv. ex. | | | | | | | | 0.0016 | 2.51 | QT | 2.2 | 132 | 7.2 | G |
| 73 | Inv. ex. | | 0.0016 | 0.0010 | | | | | 0.0006 | 3.00 | QT | 2.6 | 134 | 9.1 | G |
| 74 | Inv. ex. | | | | | | | | 0.0010 | 3.00 | QT | 1.9 | 130 | 8.2 | G |
| 75 | Inv. ex. | | 0.0022 | 0.0017 | | | | | 0.0009 | 2.00 | QT | 2.9 | 130 | 6.4 | G |
| 76 | Comp. ex. | | | | | | | | 0.0012 | 2.90 | Normal. | 5.8 | 97 | 17.0 | P |
| 77 | Comp. ex. | | | | | | | | 0.0013 | 3.05 | Normal. | 5.8 | 119 | 21.1 | G |
| 78 | Comp. ex. | | | | | | | | 0.0017 | 2.83 | Normal. | 5.8 | 100 | 24.4 | G |
| 79 | Comp. ex. | | | | | | | | 0.0011 | 3.03 | Normal. | 5.3 | 119 | 24.2 | G |
| 80 | Comp. ex. | | | | | | | | 0.0013 | 0.90 | — | — | — | — | — |
| 81 | Comp. ex. | | | | | | | | 0.0027 | 2.81 | Normal. | 5.9 | 117 | 24.5 | P |

TABLE 7

| Cutting conditions | Drill | Others |
|---|---|---|
| Cutting speed: 80 m/min<br>Feed: 0.05 mm/rev<br>Insoluble machining oil | ϕ5 mm NACHI ordinary drill, projection amount 60 mm | Hole depth: 15 mm<br>Tool life: Until breakage |

TABLE 8

| Cutting conditions | Tool | Others |
|---|---|---|
| Cutting speed: 80 m/min<br>Feed: 0.05 mm/rev<br>Insoluble machining oil | SKH57 equivalent<br>Rake angle: 20°<br>Relief angle: 6° | Projection<br>Evaluation timing: 200 cycles |

Example 2

Parts of the test materials shown in Table 9, Table 10 (continuation 1 of Table 9), Table 11 (continuation 2 of Table 9), Table 12 (continuation 3 of Table 9), Table 13 (continuation 4 of Table 9), and Table 14 (continuation 5 of Table 9) were produced by a 270 t converter, then casted at a cooling rate of 10 to 100° C./min. The billet was bloomed, then further rolled to ϕ50 mm. Further, the rest was melted in a 2 t vacuum melting furnace and rolled to ϕ50 mm. At this time, the cooling rate of the billet was adjusted by changing the cross-sectional dimensions of the casting mold. The machinability of the material was evaluated by a drilling test of the conditions shown in Table 7 and plunge cutting of the conditions shown in Table 8. The drill boring test is a method evaluating the machinability by the maximum cutting speed (so-called VL1000, unit m/min) enabling cutting up to a cumulative hole depth of 1000 mm. Plunge cutting is a method of evaluating the surface roughness by transferring a tool shape by a cutting tool. The experimental method is shown in FIG. 7(*a*) and FIG. 7(*b*). In this experiment, the surface roughness in the case of cutting 200 grooves was measured by a surface roughness meter. The 10-point surface roughness Rz (unit: μm) was used as an indicator of the surface roughness.

The density of the sulfides mainly comprised of Mns of dimensions of a circle equivalent diameter of 0.1 to 0.5 μm density was measured by taking a sample by the extraction replica method from the Q part of the cross-section parallel to the rolling direction after rolling to ϕ50 mm and observing it under a transmission type electronmicroscope. The measurement was conducted by observing at least 40 fields of 80 $\mu m^2$ at ×10000 power and converting to the number of sulfides mainly comprised of MnS per square mm. The steels with the calculated values of equation (1) of Table 10, Table 12, and Table 14 are development steels satisfying the present invention.

As shown in FIG. 2(*a*) and FIG. 2(*b*), MnS of a size which cannot be confirmed at the opticalmicroscope level is clearly different in dimensions and density in the inventions of the examples and comparative examples by observation of TEM replicas.

Note that the cutting resistance and chip disposal of Table 10, Table 12, and Table 14 are as follows. The cutting resistance was measured by attaching a piezoelectric dynamometer (made by Kistler) to the turret of a lathe, setting the tool on it to give the same position as normal cutting, and performing plunge cutting. Due to this, measurement is possible using the main force component and back force component applied to the tool as voltage signals. The cutting speed, feed speed, and other cutting conditions are similar to those for evaluation of the cut surface roughness.

Regarding chip disposal, it is preferable that the chips be small in curvature at the time of curling or that they be broken. Therefore, chips extending long curled 3 or more turns by a radius of curvature over 20 mm are deemed defective. Chips with a large number of turns and small radius of curvature or chips with a large radius of curvature and length not reaching 100 mm are deemed good.

In machinability, the examples of the present invention were superior in drill tool life compared with any of the comparative examples and were good in surface roughness at plunge cutting. In particular, it was possible to obtain an extremely superior value of surface roughness by the effect of compound precipitation of the fine MnS and BN.

TABLE 9

| | | Chemical ingredients (wt %) | | | | | | | | | |
|---|---|---|---|---|---|---|---|---|---|---|---|
| Cl | St'1 | C | Si | Mn | P | S | Total N | Total O | B | V | Nb |
| Inv. | 1 | 0.051 | 0.012 | 0.83 | 0.076 | 0.56 | 0.0140 | 0.0202 | 0.0070 | | |
| ex. | 2 | 0.033 | 0.003 | 0.76 | 0.084 | 0.52 | 0.0124 | 0.0153 | 0.0066 | | |
| | 3 | 0.021 | 0.005 | 1.05 | 0.079 | 0.54 | 0.0044 | 0.0177 | 0.0061 | | |
| | 4 | 0.052 | 0.010 | 0.91 | 0.075 | 0.47 | 0.0148 | 0.0157 | 0.0059 | | |
| | 5 | 0.053 | 0.009 | 1.45 | 0.071 | 0.61 | 0.0125 | 0.0184 | 0.0079 | | |
| | 6 | 0.021 | 0.012 | 1.31 | 0.077 | 0.62 | 0.0051 | 0.0207 | 0.0079 | | |
| | 7 | 0.053 | 0.005 | 1.72 | 0.077 | 0.60 | 0.0044 | 0.0202 | 0.0077 | | |
| | 8 | 0.021 | 0.014 | 1.31 | 0.081 | 0.46 | 0.0113 | 0.0187 | 0.0068 | | |
| | 9 | 0.057 | 0.013 | 1.07 | 0.080 | 0.54 | 0.0126 | 0.0181 | 0.0070 | 0.10 | |
| | 10 | 0.055 | 0.008 | 1.10 | 0.078 | 0.56 | 0.0051 | 0.0175 | 0.0079 | | 0.005 |
| | 11 | 0.052 | 0.011 | 1.17 | 0.079 | 0.59 | 0.0082 | 0.0202 | 0.0056 | | |
| | 12 | 0.051 | 0.006 | 1.15 | 0.080 | 0.58 | 0.0121 | 0.0209 | 0.0066 | | |
| | 13 | 0.029 | 0.010 | 0.93 | 0.089 | 0.48 | 0.0118 | 0.0194 | 0.0053 | | |
| | 14 | 0.059 | 0.012 | 0.90 | 0.077 | 0.46 | 0.0110 | 0.0190 | 0.0057 | | |
| | 15 | 0.055 | 0.005 | 0.98 | 0.076 | 0.50 | 0.0069 | 0.0208 | 0.0066 | | |
| | 16 | 0.021 | 0.008 | 1.03 | 0.087 | 0.52 | 0.0078 | 0.0200 | 0.0078 | | |
| | 17 | 0.031 | 0.010 | 0.90 | 0.088 | 0.48 | 0.0067 | 0.0158 | 0.0054 | | |
| | 18 | 0.052 | 0.004 | 0.89 | 0.078 | 0.45 | 0.0071 | 0.0181 | 0.0073 | | |
| | 19 | 0.053 | 0.011 | 0.95 | 0.086 | 0.49 | 0.0120 | 0.0190 | 0.0073 | | |
| | 20 | 0.023 | 0.008 | 1.04 | 0.077 | 0.53 | 0.0135 | 0.0205 | 0.0079 | | |
| | 21 | 0.039 | 0.002 | 1.09 | 0.061 | 0.55 | 0.0128 | 0.0151 | 0.0062 | | |
| | 22 | 0.051 | 0.008 | 1.05 | 0.076 | 0.54 | 0.0102 | 0.0208 | 0.0051 | | |
| | 23 | 0.053 | 0.008 | 1.11 | 0.083 | 0.57 | 0.0077 | 0.0162 | 0.0078 | | |
| | 24 | 0.029 | 0.010 | 0.98 | 0.088 | 0.50 | 0.0065 | 0.0184 | 0.0057 | | |
| | 25 | 0.053 | 0.004 | 1.13 | 0.080 | 0.57 | 0.0169 | 0.0109 | 0.0066 | | |
| | 26 | 0.051 | 0.011 | 1.04 | 0.077 | 0.53 | 0.0092 | 0.0160 | 0.0076 | | |
| | 27 | 0.065 | 0.005 | 0.67 | 0.087 | 0.46 | 0.0152 | 0.0165 | 0.0050 | | |
| | 28 | 0.064 | 0.010 | 0.75 | 0.082 | 0.52 | 0.0048 | 0.0161 | 0.0075 | | |

TABLE 9-continued

| | | | | | | | | | |
|---|---|---|---|---|---|---|---|---|---|
| | 29 | 0.111 | 0.010 | 1.03 | 0.071 | 0.53 | 0.0053 | 0.0200 | 0.0056 |
| | 30 | 0.055 | 0.014 | 1.12 | 0.080 | 0.57 | 0.0064 | 0.0162 | 0.0075 |

| | | Chemical ingredients (wt %) | | | | | | | | |
|---|---|---|---|---|---|---|---|---|---|---|
| Cl | St'1 | Cr | Mo | W | Ni | Cu | Su | Zn | Ti | Ca |
| Inv. | 1 | | | | | | | | | |
| ex. | 2 | | | | | | | | | |
| | 3 | | | | | | | | | |
| | 4 | | | | | | | | | |
| | 5 | | | | | | | | | |
| | 6 | | | | | | | | | |
| | 7 | | | | | | | | | |
| | 8 | | | | | | | | | |
| | 9 | | | | | | | | | |
| | 10 | | | | | | | | | |
| | 11 | 0.41 | | | | | | | | |
| | 12 | | 0.36 | | | | | | | |
| | 13 | | | 0.10 | 0.23 | | | | | |
| | 14 | | | | 0.11 | 0.28 | | | | |
| | 15 | | | | | 0.28 | | | | |
| | 16 | | | | | | 0.23 | | | |
| | 17 | | | | | | 0.03 | 0.0065 | | |
| | 18 | | | | | | | 0.0100 | | |
| | 19 | | | | | | | | 0.038 | |
| | 20 | | | | | | | | | 0.0018 |
| | 21 | | | | | | | | | |
| | 22 | | | | | | | | | |
| | 23 | | | | | | | | | |
| | 24 | | | | | | | | | |
| | 25 | | | | | | | | | |
| | 26 | | | | | | | | | |
| | 27 | | | | | | | | | |
| | 28 | | | | | | | | | |
| | 29 | | | | | | | | | |
| | 30 | | | | | | | | | |

TABLE 10

(continuation 1 of Table 9)

| | | Chemical ingredients (wt %) | | | | | | Cooling speed at casting | Rolling finishing temp. |
|---|---|---|---|---|---|---|---|---|---|
| Class | St'1 | Zr | Mg | Te | Bi | Pb | Al | [° C./min] | (° C.) |
| Inv. | 1 | | | | | | 0.002 | 100 | 1097 |
| ex. | 2 | | | | | | 0.004 | 72 | 1073 |
| | 3 | | | | | | 0.004 | 64 | 1020 |
| | 4 | | | | | | 0.003 | 55 | 1035 |
| | 5 | | | | | | 0.003 | 47 | 1029 |
| | 6 | | | | | | 0.002 | 34 | 1055 |
| | 7 | | | | | | 0.002 | 37 | 1079 |
| | 8 | | | | | | 0.001 | 92 | 1031 |
| | 9 | | | | | | 0.004 | 66 | 1176 |
| | 10 | | | | | | 0.004 | 14 | 1104 |
| | 11 | | | | | | 0.005 | 37 | 1098 |
| | 12 | | | | | | 0.002 | 28 | 1181 |
| | 13 | | | | | | 0.002 | 82 | 1173 |
| | 14 | | | | | | 0.005 | 88 | 1096 |
| | 15 | | | | | | 0.003 | 97 | 1145 |
| | 16 | | | | | | 0.003 | 67 | 1101 |
| | 17 | | | | | | 0.001 | 39 | 1165 |
| | 18 | | | | | | 0.003 | 77 | 1116 |
| | 19 | | | | | | 0.002 | 87 | 1012 |
| | 20 | 0.0020 | | | | | 0.002 | 86 | 1001 |
| | 21 | | 0.0038 | | | | 0.003 | 92 | 1153 |
| | 22 | 0.0029 | 0.0026 | | | | 0.002 | 54 | 1103 |
| | 23 | | | 0.0020 | | | 0.006 | 82 | 1124 |
| | 24 | | | | 0.256 | | 0.005 | 38 | 1129 |
| | 25 | | | | | 0.16 | 0.002 | 80 | 1018 |
| | 26 | | | | | | 0.001 | 95 | 1199 |
| | 27 | | | | | | 0.002 | 77 | 1131 |
| | 28 | | | | | | 0.003 | 20 | 1173 |

TABLE 10-continued (continuation 1 of Table 9)

| | | | | | | | | | |
|---|---|---|---|---|---|---|---|---|---|
| | 29 | | | | | 0.002 | 47 | | 1089 |
| | 30 | | | | | 0.004 | 91 | | 1133 |

| Class | St'1 | TEM replica MnS density (/mm$^2$) | BN comp. prec. rate (%) | VL1000 (m/min) | Surface roughness {μmRz} | Cutting resistance (N) Back force comp. | Cutting resistance (N) Main force comp. | Chip disp. | Cal. val. of eq. (1) |
|---|---|---|---|---|---|---|---|---|---|
| Inv. | 1 | 353565 | 20 | 145 | 6.7 | 65 | 390 | G | 0.09 |
| ex. | 2 | 249998 | 15 | 149 | 5.4 | 73 | 342 | G | 0.06 |
| | 3 | 328542 | 29 | 142 | 7.0 | 86 | 358 | G | 0.13 |
| | 4 | 262595 | 25 | 148 | 4.1 | 64 | 383 | G | 0.14 |
| | 5 | 166778 | 16 | 149 | 8.9 | 87 | 385 | G | 0.19 |
| | 6 | 178854 | 29 | 133 | 8.4 | 72 | 352 | G | 0.23 |
| | 7 | 148887 | 12 | 142 | 7.4 | 71 | 332 | G | 0.16 |
| | 8 | 305248 | 28 | 140 | 7.9 | 67 | 339 | G | 0.07 |
| | 9 | 299171 | 18 | 131 | 5.2 | 84 | 331 | G | 0.05 |
| | 10 | 82353 | 22 | 136 | 5.9 | 90 | 350 | G | 0.06 |
| | 11 | 186895 | 16 | 141 | 8.8 | 80 | 368 | G | 0.29 |
| | 12 | 142954 | 28 | 140 | 4.6 | 83 | 342 | G | 0.16 |
| | 13 | 384851 | 27 | 144 | 4.5 | 72 | 381 | G | 0.21 |
| | 14 | 394447 | 20 | 132 | 4.4 | 62 | 336 | G | 0.17 |
| | 15 | 432218 | 18 | 141 | 5.0 | 67 | 367 | G | 0.05 |
| | 16 | 260532 | 26 | 139 | 4.4 | 72 | 380 | G | 0.01 |
| | 17 | 120677 | 22 | 143 | 6.7 | 62 | 342 | G | 0.19 |
| | 18 | 266882 | 12 | 137 | 4.2 | 78 | 355 | G | 0.05 |
| | 19 | 407007 | 21 | 135 | 5.8 | 69 | 377 | G | 0.02 |
| | 20 | 333280 | 11 | 148 | 6.1 | 73 | 346 | G | 0.01 |
| | 21 | 366185 | 12 | 147 | 4.5 | 69 | 380 | G | 0.13 |
| | 22 | 303000 | 23 | 138 | 5.3 | 69 | 367 | G | 0.26 |
| | 23 | 285444 | 24 | 147 | 4.3 | 62 | 379 | G | 0.08 |
| | 24 | 243854 | 10 | 134 | 6.1 | 74 | 360 | G | 0.15 |
| | 25 | 365823 | 22 | 145 | 5.6 | 66 | 332 | G | 0.13 |
| | 26 | 309532 | 10 | 139 | 4.7 | 75 | 387 | G | 0.02 |
| | 27 | 255448 | 13 | 134 | 6.7 | 83 | 363 | G | 0.28 |
| | 28 | 146979 | 20 | 145 | 4.3 | 84 | 366 | G | 0.01 |
| | 29 | 260872 | 18 | 145 | 8.9 | 66 | 332 | G | 0.17 |
| | 30 | 281096 | 22 | 145 | 6.9 | 65 | 369 | G | 0.09 |

TABLE 11

(continuation 2 of Table 9

| Cl. | St'1 | Chemical ingredients (wt %) C | Si | Mn | P | S | Total N | Total O | B | V | Nb | Cr | Mo | W | Ni | Cu | Su | Zn | Ti | Ca |
|---|---|---|---|---|---|---|---|---|---|---|---|---|---|---|---|---|---|---|---|---|
| Inv. | 31 | 0.116 | 0.003 | 1.37 | 0.073 | 0.55 | 0.0119 | 0.0208 | 0.0078 | | | | | | | | | | | |
| ex. | 32 | 0.077 | 0.004 | 1.39 | 0.070 | 0.56 | 0.0089 | 0.0168 | 0.0060 | | | | | | | | | | | |
| | 33 | 0.071 | 0.007 | 1.32 | 0.084 | 0.46 | 0.0135 | 0.0154 | 0.0063 | | | | | | | | | | | |
| | 34 | 0.102 | 0.013 | 1.36 | 0.088 | 0.48 | 0.0140 | 0.0177 | 0.0077 | | | | | | | | | | | |
| | 35 | 0.054 | 0.003 | 1.69 | 0.073 | 0.56 | 0.0133 | 0.0163 | 0.0067 | | | | | | | | | | | |
| | 36 | 0.056 | 0.007 | 1.57 | 0.075 | 0.55 | 0.0139 | 0.0183 | 0.0060 | | | | | | | | | | | |
| | 37 | 0.159 | 0.011 | 0.74 | 0.084 | 0.51 | 0.0115 | 0.0194 | 0.0054 | | | | | | | | | | | |
| | 38 | 0.176 | 0.004 | 0.73 | 0.072 | 0.50 | 0.0147 | 0.0167 | 0.0059 | | | | | | | | | | | |
| | 39 | 0.177 | 0.014 | 0.97 | 0.071 | 0.49 | 0.0053 | 0.0177 | 0.0075 | | | | | | | | | | | |
| | 40 | 0.182 | 0.004 | 1.04 | 0.080 | 0.53 | 0.0105 | 0.0166 | 0.0053 | | | | | | | | | | | |
| | 41 | 0.150 | 0.004 | 1.29 | 0.073 | 0.49 | 0.0124 | 0.0189 | 0.0056 | | | | | | | | | | | |
| | 42 | 0.199 | 0.012 | 1.42 | 0.087 | 0.57 | 0.0120 | 0.0174 | 0.0075 | | | | | | | | | | | |
| | 43 | 0.189 | 0.015 | 1.30 | 0.073 | 0.45 | 0.0104 | 0.0160 | 0.0076 | | | | | | | | | | | |
| | 44 | 0.165 | 0.010 | 1.33 | 0.080 | 0.46 | 0.0148 | 0.0209 | 0.0067 | | | | | | | | | | | |
| | 45 | 0.171 | 0.007 | 1.34 | 0.077 | 0.47 | 0.0177 | 0.0156 | 0.0078 | | | | | | | | | | | |
| | 46 | 0.191 | 0.009 | 1.56 | 0.089 | 0.55 | 0.0112 | 0.0153 | 0.0065 | | | | | | | | | | | |
| | 47 | 0.051 | 0.008 | 1.03 | 0.086 | 0.51 | 0.0110 | 0.0050 | 0.0072 | | | | | | | | | | 0.005 | |
| | 48 | 0.031 | 0.003 | 1.03 | 0.078 | 0.52 | 0.0100 | 0.0185 | 0.0115 | | | | | | | | | | | 0.0020 |
| | 49 | 0.053 | 0.004 | 1.02 | 0.080 | 0.53 | 0.0103 | 0.0159 | 0.0078 | | | | | | | | | | | 0.0019 |
| | 50 | 0.084 | 0.008 | 1.01 | 0.082 | 0.52 | 0.0084 | 0.0040 | 0.0112 | | | | | | | | | | | |
| | 51 | 0.065 | 0.006 | 1.01 | 0.081 | 0.46 | 0.0110 | 0.0152 | 0.0100 | | | | | | | | | | | |
| | 52 | 0.057 | 0.008 | 1.03 | 0.080 | 0.53 | 0.0109 | 0.0156 | 0.0132 | | | | | | | | | | | |
| | 53 | 0.049 | 0.008 | 1.05 | 0.082 | 0.50 | 0.0112 | 0.0125 | 0.0112 | | | | | | | | | | | |
| | 54 | 0.079 | 0.010 | 0.99 | 0.072 | 0.47 | 0.0113 | 0.0145 | 0.0108 | | | | | | | | | | | |
| | 55 | 0.082 | 0.008 | 1.34 | 0.080 | 0.67 | 0.0106 | 0.0121 | 0.0035 | | | | | | | | | | | |

TABLE 11-continued (continuation 2 of Table 9)

| Cl. | St'l | Chemical ingredients (wt %) C | Si | Mn | P | S | Total N | Total O | B | V | Nb | Cr | Mo | W | Ni | Cu | Su | Zn | Ti | Ca |
|---|---|---|---|---|---|---|---|---|---|---|---|---|---|---|---|---|---|---|---|---|
| | 56 | 0.064 | 0.010 | 1.12 | 0.079 | 0.50 | 0.0112 | 0.0134 | 0.0105 | | | | | | | | | | 0.006 | |
| | 57 | 0.055 | 0.010 | 1.15 | 0.074 | 0.49 | 0.0108 | 0.0127 | 0.0114 | | | | | | | | | | | 0.0015 |
| | 58 | 0.070 | 0.010 | 1.20 | 0.071 | 0.51 | 0.0112 | 0.0184 | 0.0112 | | | | | | | | | | | 0.0018 |
| | 59 | 0.076 | 0.009 | 0.81 | 0.077 | 0.30 | 0.0111 | 0.0147 | 0.0121 | | | | | | | | | | | |
| | 60 | 0.081 | 0.008 | 1.34 | 0.079 | 0.64 | 0.0109 | 0.0156 | 0.0121 | | | | | | | | | | | |

TABLE 12

(continuation 3 of Table 9)

| Cl. | St'l | Chemical ingredients (wt %) Zr | Mg | Te | Bi | Pb | Al | Cooling speed at casting (° C./min) | Rolling finishing temp. (° C.) | TEM replica MnS density (/mm²) | BN comp. prec. rate (%) | VL1000 (m/min) | Surface rough-ness (μmRz) | Cutting resistance (N) Back force comp. | Main force comp. | Chip disp. | Cal. val. of eq. (1) |
|---|---|---|---|---|---|---|---|---|---|---|---|---|---|---|---|---|---|
| Inv. | 31 | | | | | | 0.003 | 16 | 1057 | 85221 | 14 | 132 | 7.6 | 82 | 386 | G | 0.04 |
| ex. | 32 | | | | | | 0.002 | 45 | 1120 | 142738 | 15 | 147 | 7.9 | 79 | 338 | G | 0.18 |
| | 33 | | | | | | 0.002 | 16 | 1017 | 61245 | 10 | 149 | 7.0 | 65 | 371 | G | 0.11 |
| | 34 | | | | | | 0.003 | 78 | 1110 | 272514 | 28 | 133 | 7.8 | 70 | 349 | G | 0.01 |
| | 35 | | | | 0.17 | | 0.002 | 77 | 1168 | 262609 | 15 | 135 | 4.9 | 63 | 344 | G | 0.10 |
| | 36 | | | | | 0.298 | 0.002 | 21 | 1106 | 81541 | 18 | 146 | 5.0 | 61 | 335 | G | 0.15 |
| | 37 | | | | | | 0.003 | 52 | 1100 | 194907 | 16 | 145 | 5.5 | 73 | 351 | G | 0.19 |
| | 38 | | | | | | 0.002 | 59 | 1085 | 301851 | 15 | 132 | 6.9 | 80 | 378 | G | 0.13 |
| | 39 | | | | | | 0.001 | 22 | 1191 | 125206 | 30 | 145 | 6.7 | 74 | 382 | G | 0.01 |
| | 40 | | | | | | 0.003 | 74 | 1125 | 262061 | 11 | 135 | 5.0 | 75 | 358 | G | 0.21 |
| | 41 | | | | | | 0.003 | 23 | 1036 | 108319 | 19 | 144 | 7.6 | 67 | 331 | G | 0.16 |
| | 42 | | | | | | 0.002 | 50 | 1163 | 170214 | 17 | 133 | 8.7 | 87 | 379 | G | 0.09 |
| | 43 | | | | | | 0.003 | 11 | 1171 | 50750 | 25 | 137 | 6.7 | 67 | 366 | G | 0.04 |
| | 44 | | | | | | 0.004 | 69 | 1098 | 234200 | 10 | 138 | 7.0 | 83 | 388 | G | 0.07 |
| | 45 | | | | 0.286 | | 0.004 | 53 | 1095 | 289829 | 14 | 148 | 6.8 | 89 | 332 | G | 0.02 |
| | 46 | | | | | 0.20 | 0.003 | 53 | 1089 | 186791 | 22 | 147 | 6.0 | 80 | 333 | G | 0.10 |
| | 47 | | | | | | 0.002 | 89 | 1011 | 416010 | 26 | 140 | 5.5 | 66 | 354 | G | 0.02 |
| | 48 | 0.0018 | | | | | 0.001 | 85 | 1000 | 333350 | 13 | 144 | 6.2 | 72 | 344 | G | 0.35 |
| | 49 | 0.0021 | | | | | 0.001 | 86 | 1003 | 353921 | 12 | 139 | 6.1 | 70 | 352 | G | 0.02 |
| | 50 | 0.0010 | | | | | 0.003 | 20 | 1173 | 146542 | 22 | 145 | 4.5 | 84 | 366 | G | 0.29 |
| | 51 | | | | | | 0.002 | 78 | 1130 | 253458 | 21 | 145 | 4.0 | 81 | 352 | G | 0.23 |
| | 52 | | | | | | 0.001 | 79 | 1126 | 262337 | 20 | 140 | 4.1 | 82 | 362 | G | 0.77 |
| | 53 | | | | | | 0.001 | 65 | 1002 | 189562 | 20 | 140 | 4.1 | 82 | 345 | G | 0.28 |
| | 54 | | | | | | 0.001 | 82 | 1121 | 252563 | 21 | 135 | 4.4 | 84 | 361 | G | 0.23 |
| | 55 | | | | | | 0.001 | 54 | 1056 | 164512 | 20 | 140 | 4.1 | 81 | 361 | G | 1.02 |
| | 56 | | | | | | 0.001 | 77 | 1096 | 132654 | 17 | 135 | 5.1 | 82 | 375 | G | 0.17 |
| | 57 | 0.0012 | | | | | 0.001 | 78 | 1059 | 192563 | 14 | 135 | 5.6 | 84 | 375 | G | 0.32 |
| | 58 | 0.0014 | | | | | 0.001 | 62 | 1100 | 189562 | 15 | 135 | 5.7 | 81 | 352 | G | 0.29 |
| | 59 | 0.0011 | | | | | 0.001 | 50 | 1058 | 123654 | 16 | 140 | 4.9 | 86 | 362 | G | 1.11 |
| | 60 | | | | | | 0.001 | 51 | 1123 | 165842 | 14 | 135 | 5.2 | 83 | 374 | G | 0.78 |

TABLE 13

(continuation 4 of Table 9)

| Cl. | St'l | Chemical ingredients (wt %) C | Si | Mn | P | S | Total N | Total O | B | V | Nb | Cr | Mo | W | Ni | Cu | Su | Zn | Ti | Ca |
|---|---|---|---|---|---|---|---|---|---|---|---|---|---|---|---|---|---|---|---|---|
| Inv. | 61 | 0.060 | 0.008 | 1.45 | 0.080 | 0.65 | 0.0112 | 0.0132 | 0.0050 | | | | | | | | | | | |
| ex. | 62 | 0.061 | 0.011 | 0.75 | 0.076 | 0.33 | 0.0104 | 0.0112 | 0.0110 | | | | | | | | | | | |
| | 63 | 0.068 | 0.008 | 1.51 | 0.081 | 0.58 | 0.0132 | 0.0156 | 0.0110 | | | | | | | | | | | |
| | 64 | 0.072 | 0.009 | 0.71 | 0.072 | 0.30 | 0.0122 | 0.0125 | 0.0110 | | | | | | | | | | | |
| | 65 | 0.082 | 0.008 | 0.88 | 0.077 | 0.34 | 0.0118 | 0.0135 | 0.0043 | | | | | | | | | | | |
| Comp. | 66 | 0.081 | 0.003 | 0.93 | 0.077 | 0.31 | 0.0099 | 0.0170 | | | | | | | | | | | | |
| ex. | 67 | 0.072 | 0.010 | 0.75 | 0.076 | 0.24 | 0.0069 | 0.0184 | | | | | | | | | | | | |
| | 68 | 0.097 | 0.017 | 0.90 | 0.072 | 0.30 | 0.0095 | 0.0175 | | | | | | | | | | | | |
| | 69 | 0.067 | 0.006 | 0.92 | 0.077 | 0.30 | 0.0142 | 0.0168 | | | | | | | | | | | | |
| | 70 | 0.069 | 0.011 | 0.843 | 0.088 | 0.28 | 0.0130 | 0.0177 | | | | | | | | | | | | |
| | 71 | 0.089 | 0.012 | 0.37 | 0.070 | 0.12 | 0.0103 | 0.0191 | | | | | | | | | | | | |

TABLE 13-continued (continuation 4 of Table 9)

| Cl. | St'l | Chemical ingredients (wt %) C | Si | Mn | P | S | Total N | Total O | B | V | Nb | Cr | Mo | W | Ni | Cu | Su | Zn | Ti | Ca |
|---|---|---|---|---|---|---|---|---|---|---|---|---|---|---|---|---|---|---|---|---|
| | 72 | 0.092 | 0.019 | 0.31 | 0.079 | 0.11 | 0.0166 | 0.0174 | | | | | | | | | | | | |
| | 73 | 0.096 | 0.014 | 0.40 | 0.089 | 0.13 | 0.0173 | 0.0177 | | | | | | | | | | | | |
| | 74 | 0.064 | 0.035 | 0.94 | 0.070 | 0.01 | 0.0133 | 0.0158 | 0.0035 | | | | | | | | | | | |
| | 75 | 0.079 | 0.036 | 0.50 | 0.071 | 0.17 | 0.0126 | 0.0178 | 0.0013 | | | | | | | | | | | |
| | 76 | 0.090 | 0.012 | 0.34 | 0.081 | 0.12 | 0.0167 | 0.0183 | 0.0030 | | | | | | | | | | | |
| | 77 | 0.089 | 0.015 | 0.98 | 0.073 | 0.32 | 0.0134 | 0.0205 | 0.0038 | | | | | | | | | | | |

TABLE 14

(continuation 5 of Table 9)

| Class | St'l | Chemical ingredients (wt %) Zr | Mg | Te | Bi | Pb | Al | Cooling speed at casting (° C./min) | Rolling finishing temp. (° C.) | TEM replica Mns density (/mm²) | BN comp. prec. rate (%) | VL1000 (m/min) | Surface roughness (μmRz) | Cutting resistance (N) Back force comp. | Main force comp. | Chip disp. | Cal. val. of eq. (1) |
|---|---|---|---|---|---|---|---|---|---|---|---|---|---|---|---|---|---|
| Inv. | 61 | | | | | | 0.002 | 71 | 1005 | 212365 | 16 | 140 | 5.0 | 81 | 366 | G | 0.61 |
| ex. | 62 | | | | | | 0.001 | 70 | 1022 | 196354 | 14 | 140 | 6.2 | 86 | 379 | G | 0.71 |
| | 63 | | | | | | 0.002 | 56 | 1006 | 156235 | 20 | 145 | 5.1 | 82 | 354 | G | 0.35 |
| | 64 | | | | | | 0.001 | 69 | 1215 | 142562 | 19 | 140 | 4.9 | 83 | 362 | G | 0.89 |
| | 65 | | | | | | 0.001 | 72 | 1231 | 212365 | 17 | 135 | 5.1 | 85 | 374 | G | 0.79 |
| Comp. | 66 | | | | | | 0.004 | 6 | 865 | 232 | 0 | 92 | 17.7 | 173 | 451 | P | 2.36 |
| ex. | 67 | | | | | | 0.004 | 7 | 820 | 194 | 0 | 95 | 19.4 | 169 | 512 | P | 2.82 |
| | 68 | | | | | | 0.002 | 5 | 784 | 214 | 0 | 66 | 18.2 | 188 | 452 | G | 2.45 |
| | 69 | | | | | | 0.001 | 2 | 831 | 53 | 0 | 83 | 15.5 | 201 | 466 | G | 2.41 |
| | 70 | | | | | | 0.002 | 5 | 814 | 192 | 0 | 99 | 15.4 | 217 | 497 | P | 2.54 |
| | 71 | | | | | | 0.001 | 8 | 763 | 227 | 0 | 73 | 18.7 | 210 | 454 | P | 4.03 |
| | 72 | | | | | | 0.003 | 4 | 799 | 161 | 0 | 79 | 18.5 | 155 | 524 | G | 4.24 |
| | 73 | | | | | | 0.004 | 3 | 821 | 141 | 0 | 66 | 19.9 | 189 | 464 | G | 3.95 |
| | 74 | | | | | | 0.002 | 8 | 844 | 207 | 0 | 75 | 17.8 | 152 | 500 | P | 4.39 |
| | 75 | | | | | | 0.001 | 2 | 774 | 57 | 0 | 93 | 16.9 | 209 | 481 | P | 3.02 |
| | 76 | | | | | | 0.003 | 6 | 891 | 180 | 1 | 93 | 17.9 | 217 | 486 | G | 3.07 |
| | 77 | | | | | | 0.004 | 6 | 827 | 154 | 1 | 83 | 15.3 | 199 | 523 | G | 1.10 |

INDUSTRIAL APPLICABILITY

As explained above, the present invention enables use for automobile parts and general machinery parts have superior properties of tool life and cut surface roughness at the time of cutting and disposal of chips.

The invention claimed is:

1. Steel superior in machinability comprised of, by wt %,

C: 0.005 to 0.2%,

Si: 0.001 to 0.5%,

Mn: 0.2 to 3.0%,

P: 0.001 to 0.2%,

T.N: 0.002 to 0.02%,

T.O: 0.0005 to 0.035%, restricting the amount of S to 0.25 to 0.75 wt % and the amount of B to 0.002 to 0.014 wt %, by containing amounts of S and B in a region surrounded by A, B, C, and D shown in FIG. 4 where the contents of S and B satisfy the following equation (1), and by containing sulfides with BN precipitated in MnS:

$$(B-0.008)^2/0.006^2+(S-0.5)^2/0.25^2 \leqq 1 \quad (1)$$

the balance of Fe and unavoidable impurities, said steel satisfying one or both of Mn/S in the steel being 1.2 to 2.8 or an area ratio of pearlite over a grain size of 1 μm in a microstructure of the steel being not more than 5%, and having a density of MnS having a circle equivalent diameter of 0.1 to 0.5 μm at a cross-section parallel to a rolling direction of the steel material, taken from an extraction replica and observed by a transmission electron microscope, of at least 10,000/mm².

2. Steel superior in machinability as set forth in claim 1, said steel characterized by further containing, by wt %, one or more of, V: 0.05 to 1.0%, Nb: 0.005 to 0.2%, Cr: 0.01 to 2.0%, Mo: 0.05 to 1.0%, W: 0.5 to 1.0%, Ni: 0.05 to 2.0%, Cu: 0.01 to 2.0%, Sn: 0.005 to 2.0%, Zn: 0.0005 to 0.5%, Ti: 0.0005 to 0.1%, Ca: 0.0002 to 0.005%, Zr: 0.0005 to 0.1%, Mg: 0.0003 to 0.005%, Te: 0.0003 to 0.05%, Bi: 0.005 to 0.5%, Pb: 0.01 to 0.5%, and Al: ≦0.015%.

* * * * *